US006743332B2

(12) United States Patent
Haynes et al.

(10) Patent No.: US 6,743,332 B2
(45) Date of Patent: Jun. 1, 2004

(54) HIGH TEMPERATURE PEROXIDE BLEACHING OF MECHANICAL PULPS

(75) Inventors: Kaaren K. Haynes, Federal Way, WA (US); Roger O. Campbell, Federal Way, WA (US); Zeecha L. Brooks, Tigard, OR (US); Anthony Parrish, Kalama, WA (US); Robert T. Hamilton, Seattle, WA (US)

(73) Assignee: Weyerhaeuser Company, Federal Way, WA (US)

( * ) Notice: Subject to any disclaimer, the term of this patent is extended or adjusted under 35 U.S.C. 154(b) by 1 day.

(21) Appl. No.: 09/860,025

(22) Filed: May 16, 2001

(65) Prior Publication Data

US 2002/0189021 A1 Dec. 19, 2002

(51) Int. Cl.[7] ..... D21C 9/16

(52) U.S. Cl. ..... 162/78; 162/55; 162/26; 162/71; 162/24; 162/90; 8/109; 8/110; 8/111

(58) Field of Search ..... 162/55, 78, 26, 162/71, 24, 90; 8/109, 110, 111

(56) References Cited

U.S. PATENT DOCUMENTS

| | | | | | |
|---|---|---|---|---|---|
| 4,029,543 | A | * | 6/1977 | Lindahl | 162/24 |
| 4,106,979 | A | * | 8/1978 | Ruffini et al. | 162/73 |
| 4,270,976 | A | | 6/1981 | Sandstrom et al. | |
| 4,311,553 | A | * | 1/1982 | Akerlund et al. | 162/23 |
| 4,363,699 | A | * | 12/1982 | DeCeuster et al. | 162/71 |
| 4,675,076 | A | * | 6/1987 | Darlington | 162/72 |
| 4,718,980 | A | | 1/1988 | Lowrie et al. | |
| H479 | H | * | 6/1988 | Wood et al. | 8/111 |
| 4,804,440 | A | * | 2/1989 | Liebergott et al. | 162/70 |
| 4,812,206 | A | * | 3/1989 | Devic et al. | 162/19 |
| 5,248,389 | A | * | 9/1993 | Heimburger et al. | 162/76 |
| H1690 | H | * | 11/1997 | Nye | 162/72 |
| 6,398,908 | B1 | * | 6/2002 | Hermansson et al. | 162/65 |
| 6,524,437 | B1 | | 2/2003 | Vincent et al. | |

FOREIGN PATENT DOCUMENTS

| | | | |
|---|---|---|---|
| AU | A-41044/99 | | 10/2000 |
| CA | 2278399 | * | 1/2000 |
| WO | WO 96/41917 | | 12/1996 |

OTHER PUBLICATIONS

Anderson, J.R., and B. Amini, "Chap. 10: Hydrogen Peroxide Bleaching," in C.W. Dence and D.W. Reeve (eds.), *Pulp Bleaching: Principles and Practice, Section IV: Chemical Pulp Bleaching*, TAPPI Press, Atlanta, 1996, pp. 411–442.

Arnevik, T.A., and N. Soteland, "Peroxide Bleaching of Mechanical Pulps at High Consistency," *International Mechanical Pulping Conference 1*:201–212, Helsinki, Jun. 6–8, 1989.

Bambrick, D.R., "The Effect of DTPA on Reducing the Peroxide Consumption," *TAPPI 68*:96–100, 1985.

(List continued on next page.)

*Primary Examiner*—Charles Boyer
(74) *Attorney, Agent, or Firm*—Christensen, O'Connor, Johnson Kindness PLLC

(57) ABSTRACT

A method of making bleached mechanical pulps is disclosed for pulping mills having a primary and a secondary refiner. A first step is to provide cellulosic materials, such as wood chips to refine into the pulp; the wood chips have an initial brightness level. A second step is to provide a bleaching liquor to the refining system of the pulp mill, wherein the liquor comprises an amount of hydrogen peroxide and an amount of alkali having greater than 0% to 100% magnesium hydroxide or soda ash or a combination thereof. A third step is to hold the pulp with the bleaching liquor at a temperature in the range of about 85° to about 160° C. and for about 2 to about 180 minutes. The components of the bleach liquor can be added at the first refiner or interstage between refiners.

41 Claims, 16 Drawing Sheets

OTHER PUBLICATIONS

Dionne, P.Y., et al., "Soda Ash and Magnesium Oxide—Alkali Sources for the Bleaching of Mechanical Pulp," *Paper Technology*, Apr. 1995, pp. 29–34.

Dionne, P.Y., et al., "The Use of Soda Ash and Magnesium Oxide as Alkali Sources for the Hydrogen Peroxide Bleaching of Mechanical Pulp," *The 18th International Mechanical Pulping Conference*, Oslo, Norway, Jun. 15–17, 1993, pp. 403–408.

Hill, R., et al., High Temperature Peroxide Bleaching of Mechanical Pulps, *Pulping Conference Book 1*, Nashville, Tennessee, Oct. 27–31, 1996, pp. 349–360.

Kuczynski, K., et al., "DTPMPA: Polyamino Polyphosphonic Acid and Its Use in Paper Processes," *TAPPI Journal* 71:171–174, 1988.

Künzel, U., et al., "Smoothing the Way," *Paper*, Apr. 1993, pp. 30–33.

Kutney, G.W., and T.D. Evans, "Peroxide Bleaching of Mechanical Pulps: Part 2. Alkali Darkening–Hydrogen Peroxide Decomposition," *Svensk Papperstidn 88*:R84–R89, 1985.

Ni, Y., et al., "Improved Transition Metal Removal in a Reducing Agent–Assisted Chelation Stage: A Laboratory Study," *Pulp Pap. Can. 99*:77–79, 1998.

Nyström, M., et al., "Peroxide Bleaching of Mechanical Pulp Using Different Types of Alkali," *Paperi Ja Puu 75*:419–425, 1993.

Prasakis, J., et al., "Metal Management Improves Peroxide Bleaching of TMP," *TAPPI 79*:161–166, 1996.

Presley, J.R., and R.T. Hill, "Chap. 1: Peroxide Bleaching of (Chemi)mechanical Pulps," in C.W. Dence and D.W. Reeve (eds.), *Pulp Bleaching: Principles and Practice, Section V: The Technology of Mechanical Pulp Bleaching*, TAPPI Press, Atlanta, 1996, pp. 457–489.

Pykäläinen, J., et al., "COD Decrease With New Alkalis in Peroxide Bleaching of Mechanical Pulps," *The 18th International Mechanical Pulping Conference*, Oslo, Norway, Jun. 15–17, 1993, pp. 154–157.

Soteland, N., et al., "Use of MgO and CaO as the Only Alkaline Source in Peroxide Bleaching of High–Yield Pulps," *International Pulp Bleaching Conference*, Orlando, Florida, 1988, pp. 231–236.

Stark, H., and M.H. Diehold, "High Temperature Bleaching of Wood Pulps by Hydrogen Peroxide," *Wocheshlatt für Papierfabritation 17*(21):959–962, 1989.

* cited by examiner

**INDICATES THE CHEMICAL WAS ADDED AT THE PRIMARY REFINER

** INDICATES THE CHEMICAL WAS ADDED AT THE PRIMARY REFINER

** INDICATES THE CHEMICAL WAS ADDED AT THE PRIMARY REFINER

**INDICATES THE CHEMICAL WAS ADDED AT THE PRIMARY REFINER

**INDICATES THE CHEMICAL WAS ADDED AT THE PRIMARY REFINER

** INDICATES THE CHEMICAL WAS ADDED AT THE PRIMARY REFINER

**INDICATES THE CHEMICAL WAS ADDED AT THE PRIMARY REFINER

**INDICATES THE CHEMICAL WAS ADDED AT THE PRIMARY REFINER

**INDICATES THE CHEMICAL WAS ADDED AT THE PRIMARY REFINER

** INDICATES THE CHEMICAL WAS ADDED AT THE PRIMARY REFINER

HIGH TEMPERATURE PEROXIDE BLEACHING OF MECHANICAL PULPS

FIELD OF THE INVENTION

The present invention is directed to processes for producing mechanical pulps, and more particularly to hydrogen peroxide bleaching of thermomechanical pulps and the resultant pulps made therefrom.

BACKGROUND OF THE INVENTION

Mechanical pulping is a process of mechanically triturating wood into its fibers for the purpose of making pulp. Mechanical pulping is attractive as a method for pulping because it achieves high yields when compared to chemical pulping because lignin is not removed from mechanically pulped woods, meaning scarce resources are more efficiently utilized. Pulps made using any of the conventional mechanical pulping methods are mainly used for newsprint, and are unsuitable for higher quality or more durable paper and products. This is due, in part, to the fact that mechanical pulps are generally more difficult to bleach than chemical pulps.

There are many variants of mechanical pulping including stone grinding (SG), pressurized stone grinding (PSG), refiner mechanical pulping (RMP), thermomechanical pulping (TMP), and chemi-thermomechanical pulping (CTMP). The latter three can further be grouped generally under refiner pulping processes. In RMP, wood chips are ground between rotating metal disks. The process usually is carried out in two stages. The first stage is mainly used to separate the fibers, while the second stage is used to treat the fiber surface for improved fiber bonding of paper products. In RMP, the wood chips are refined at atmospheric pressure in both a first and a second stage refiner. The refiner process generates heat by the friction of the metal disks against the wood. The heat is liberated as amounts of steam which is often used to soften the incoming chips.

TMP differs from RMP in that the pulp is made in a pressurized refiner. In this process, two stages are normally used also. The first stage refiner operates at elevated temperature and pressure, and the second stage refiner is at ambient conditions. The first stage separates the fibers and the second stage then treats the fibers. Pulps made by TMP have high strength, which makes the TMP process the most favored mechanical pulping process. However, there is still room for improvements. The TMP process consumes high energy, and the pulp produced by the TMP process tends to be darker than most other pulps.

CTMP uses both chemical and thermal pretreatment for processing the wood chips into pulp. CTMP is a chemi-thermomechanical process that is similar to TMP, except that the chips are first pretreated with relatively small amounts of sodium hydroxide with hydrogen peroxide under elevated temperature and pressure prior to refining. The adjuvant chemicals make the separation of the cellulosic fibers much easier in the refiners.

The foregoing list is by no means exhaustive. There are innumerable combinations and variants of the pulping processes as exemplified in *The Handbook of Pulping and Papermaking,* 2d ed., by Christopher J. Biermann, which is herein incorporated by reference. Of the mechanical pulping processes, the one which is considered by many in the field to be the most favorable, taking into consideration market conditions and environmental regulations, is the TMP process. However, were it not for the fact that chemi-thermomechanical pulping processes produce effluents of high color, high COD and BOD, which may be difficult to treat, CTMP processes would have an advantage over TMP processes because the energy grinding requirements for CTMP are about half that of TMP.

Bleaching is a term applied to a semi-chemical or chemical step in a pulping process to increase the brightness of both chemical and mechanical pulps. In mechanical pulping, the increase in brightness is achieved by altering the chemical structure of the conjugated double bonds in lignin. The conjugated double-bonded species are called chromophores. "Brightening" is the term often used when referring to bleaching of mechanical pulps to distinguish it from the bleaching process of chemical pulps, which differs by removing lignin entirely. As used hereinafter "bleaching" will be intended to cover the process of "brightening" as well. In mechanical pulps, brightening is often carried out in a single step in the pulping process. The bleaching process is conventionally carried out in a bleaching train in one or a plurality of vessels (bleach towers or stages) in a distinct section of the mill plant, as opposed to the pulping section of the mill. Brightening can be carried out using oxidative and/or reductive chemical agents including oxidating reagents, such as hydrogen peroxide and reducing agents, such as dithionite, or sodium hydrosulfate. Normally, hydrogen peroxide, an oxidizing agent, is used with sodium hydroxide. For a more thorough discussion of bleaching chemistry, reference is made to *Pulp Bleaching—Principles and Practice*, by J. Ross Anderson and B. Amini; Section V: Chapter 1: Peroxide Bleaching of (Chemi)mechanical Pulps, by J. R. Presley and R. T. Hill. Sodium hydroxide is a strong alkali and provides the requisite high pH necessary to produce the active perhydroxyl ion, $HOO^-$, thought to produce the bleaching effect in pulps. The cost of sodium hydroxide has been increasing due to changes in availability and energy costs. Concern over the environment has also meant a decrease in the available sodium hydroxide supply. Therefore, different alkali sources and different methods have been tried to find suitable alternatives for bleaching liquors and bleaching processes with limited success.

Hence, there is a need to improve existing mechanical pulping processes to provide higher brightness pulps by processes having added advantages.

SUMMARY OF THE INVENTION

When alkali peroxide bleaching at high temperatures, better brightness is obtained when using an alkali buffer (such as soda ash or magnesium hydroxide), instead of sodium hydroxide. Buffering the system at lower pH (about 9 to about 10.5) prevents peroxide decomposition and alkali darkening, but still provides adequate alkali to produce effective bleaching. The buffer releases alkalinity as necessary and provides just enough alkalinity for a slow, even production of perhydroxyl ions. The present invention provides a supply of perhydroxyl ions as needed for bleaching and prolongs the effective bleaching time, making the peroxide more effective and giving higher brightness and higher yields by reducing the breakdown of the wood fibers, thus overcoming many of the aforementioned problems.

A method of making bleached mechanical pulps is disclosed for pulping mills having a refining system. A step according to the invention is to provide a cellulosic material, such as wood chips, having an initial brightness level. A second step in the method in accordance with the invention is to introduce the cellulosic material to a refining system for conversion into a pulp. A third step in the method in accordance with the invention is to provide a bleaching liquor to the refining system, wherein the liquor comprises an amount of hydrogen peroxide and an amount of alkali, wherein up to 100% of alkali is either magnesium hydroxide, soda ash or a combination thereof. Any additional balance required to arrive at a suitable amount of alkali is supplied by NaOH. A fourth step in the method in accordance with the invention is to hold the pulp with the bleaching liquor at an effective temperature and for an effective time sufficient to increase the brightness of the pulp from the initial brightness level to brightness level equal to or higher than what can be obtained when 100% of alkali is NaOH and the pulp and bleaching liquor are contacted under about the same time and temperature conditions. Pulps having a brightness of at least 35 ISO or in the range of about 55 to 69.5 ISO are attainable by the methods of the present invention.

One embodiment uses a temperature in the range of about 85° to about 160° C. for about 2 to about 180 minutes, as the conditions under which the pulp and bleaching liquor are held. Another alternate second suitable temperature range includes greater than 100° C. to about 160° C. Three other alternate suitable time ranges include the ranges of from about 10 minutes to less than 180 minutes, or greater than 60 minutes to less than 120 minutes, or greater than 2 minutes to less than 60 minutes and the combination of these three alternate time ranges with the temperature ranges. Furthermore, any time or temperature range within the aforementioned time and temperature ranges can also be used.

In another alternate embodiment, a step of increasing the pH of the pulp to the range of about 9 to about 10.5 is provided, in addition to the steps mentioned above.

In another alternate embodiment, a method of making bleached mechanical pulps is disclosed for pulping mills having a refining system. A step according to the invention is to provide a cellulosic material having an initial brightness level. A second step in the method in accordance with the invention is to introduce a cellulosic material to a refining system for conversion to a pulp. A third step in the method in accordance with the invention is to provide a bleaching liquor to the refining system, wherein the liquor comprises a first amount of hydrogen peroxide and alkali, wherein up to 100% of alkali is magnesium hydroxide, soda ash, or a combination thereof. A fourth step in the method in accordance with the invention is to hold the pulp and the bleaching liquor at a temperature in the range of about 85° C. to about 160° C. for a time of about 2 to about 180 minutes. A fifth step in the method in accordance with the invention is to increase the brightness of the pulp about equal to or less than a brightness level which can be obtained if the bleaching liquor comprises a second amount of hydrogen peroxide which is greater than the first amount, wherein 100% of alkali is sodium hydroxide and the pulp and bleaching liquor are held under about the same time and temperature conditions.

A method of brightening TMP pulps in accordance with the invention provides significant advantages. The residual peroxide level is increased, meaning more effective use of hydrogen peroxide. A decrease in the oxalate concentration is noticed, meaning less scaling of process equipment, thereby reducing premature equipment wear. An increase in pulp yields is also realized. Furthermore, COD and BOD levels of plant effluents are reduced, which contribute to lower pollution levels entering waste water facilities.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
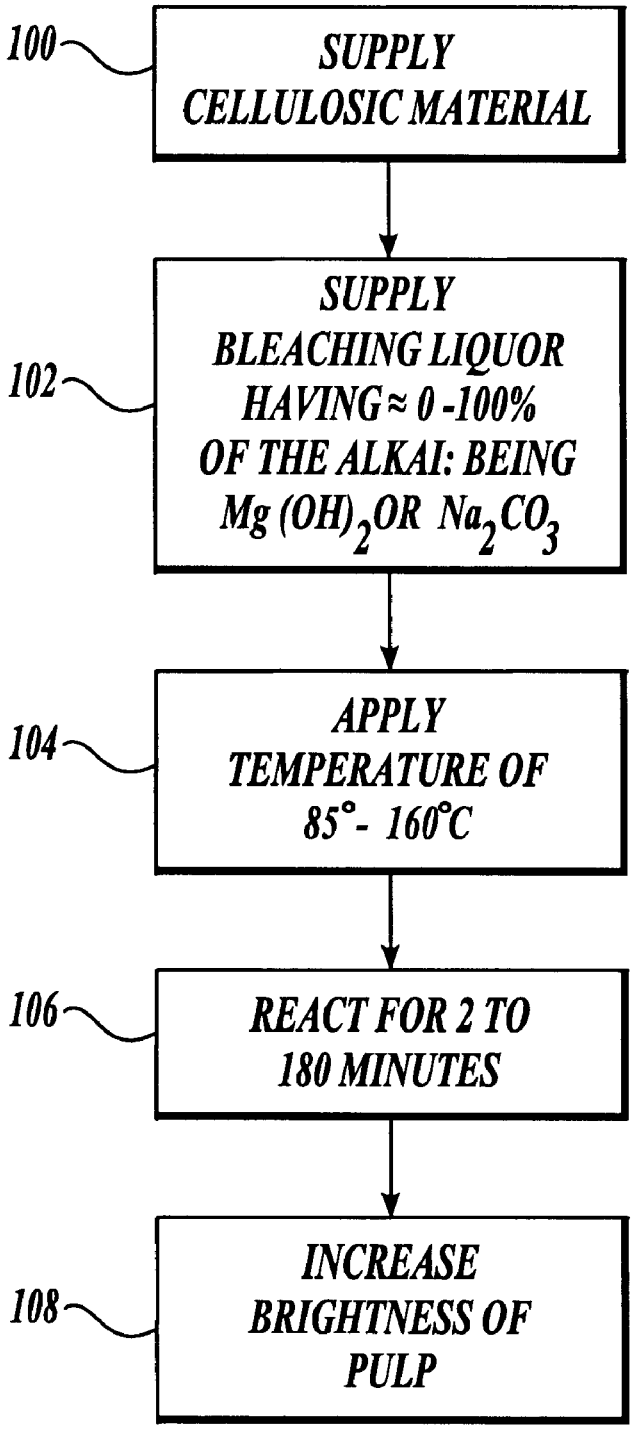
FIG. 1 shows a schematic illustration of a method of bleaching mechanical pulps according to the present invention.

Referring to FIG. 1, a schematic illustration of a method of making bleached mechanical pulp according to the present invention is illustrated. In block 100, a supply of cellulosic materials is provided; the cellulosic materials have an initial brightness level. Suitable cellulosic materials to use in the present invention are wood chips, conventionally used as feed to TMP processes. However, the present invention is not limited to wood chips. Any materials containing a quantity of cellulose and which can undergo mechanical pulping are suitable cellulosic materials for use in the present invention. This includes any softwood and hardwood species. In block 102, a supply of bleaching liquor, containing hydrogen peroxide and alkali, where the alkali includes up to 100% of magnesium hydroxide ($Mg(OH)_2$), soda ash ($Na_2CO_3$) or any mixtures thereof with the balance being sodium hydroxide (NaOH) to arrive at a suitable quantity of alkali, is added to the cellulosic material to produce a mixture. Virtually any amount of buffer capacity provided by magnesium hydroxide or soda ash or any combination thereof, partially or wholly substituted for sodium hydroxide provides favorable results. It is also to be understood that the components of the bleaching liquor may be added separately, meaning one at a time or concurrently, meaning two or more components together. It should also be understood that alkali as used herein means one or more compounds which provide alkalinity, which may be added to the bleaching liquid separately or concurrently. In block 104, the cellulosic material and the bleaching liquor are brought together as a mixture and heated to a temperature of about 85° C. to about 160° C. In block 106, the pulp and liquor are held for about 2 to about 180 minutes. The reaction of the mixture is carried out in a process vessel. It should be understood that the process vessel can be any equipment, tank, or pipe and any combination of one or more components that forms part of a refining system. In block 108, the brightness of the cellulosic material within the mixture contained within the process vessel is increased to a degree greater than the increase in brightness level achieved if the cellulosic material is brightened using a bleaching liquor wherein alkali is 100% sodium hydroxide and the pulp and bleaching liquor are held under about the same temperature and time conditions.

Figure 16:
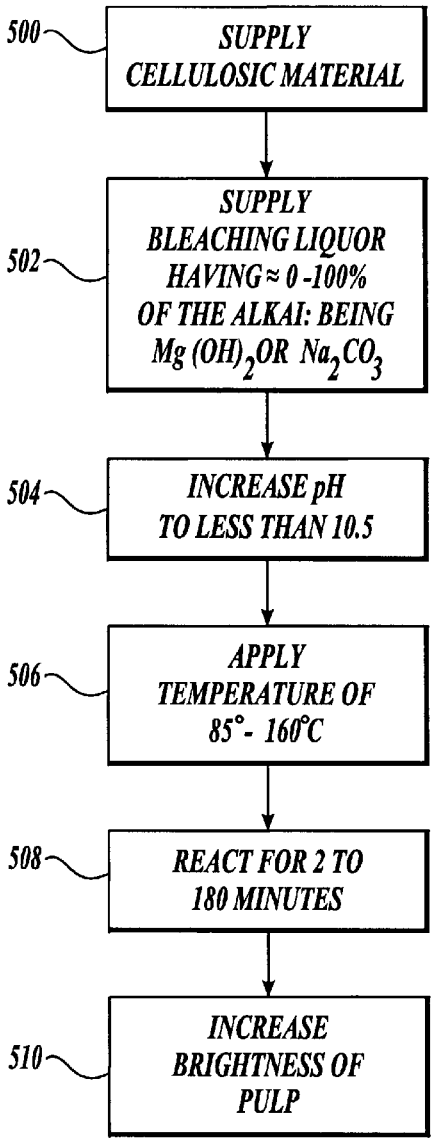
FIG. 16 shows a schematic illustration of a second embodiment of a method of bleaching mechanical pulps according to the present invention.

Referring to FIG. 16, a schematic illustration of an alternate method of making bleached mechanical pulp according to the present invention is illustrated. This embodiment is similar to the embodiment mentioned above, containing all the blocks recited above; however, an additional step, denoted as block 504, is provided to adjust the pH of the pulp mixture in the range of about 9 to about 10.5 using magnesium hydroxide and/or soda ash as a pH buffer.

Figure 2:
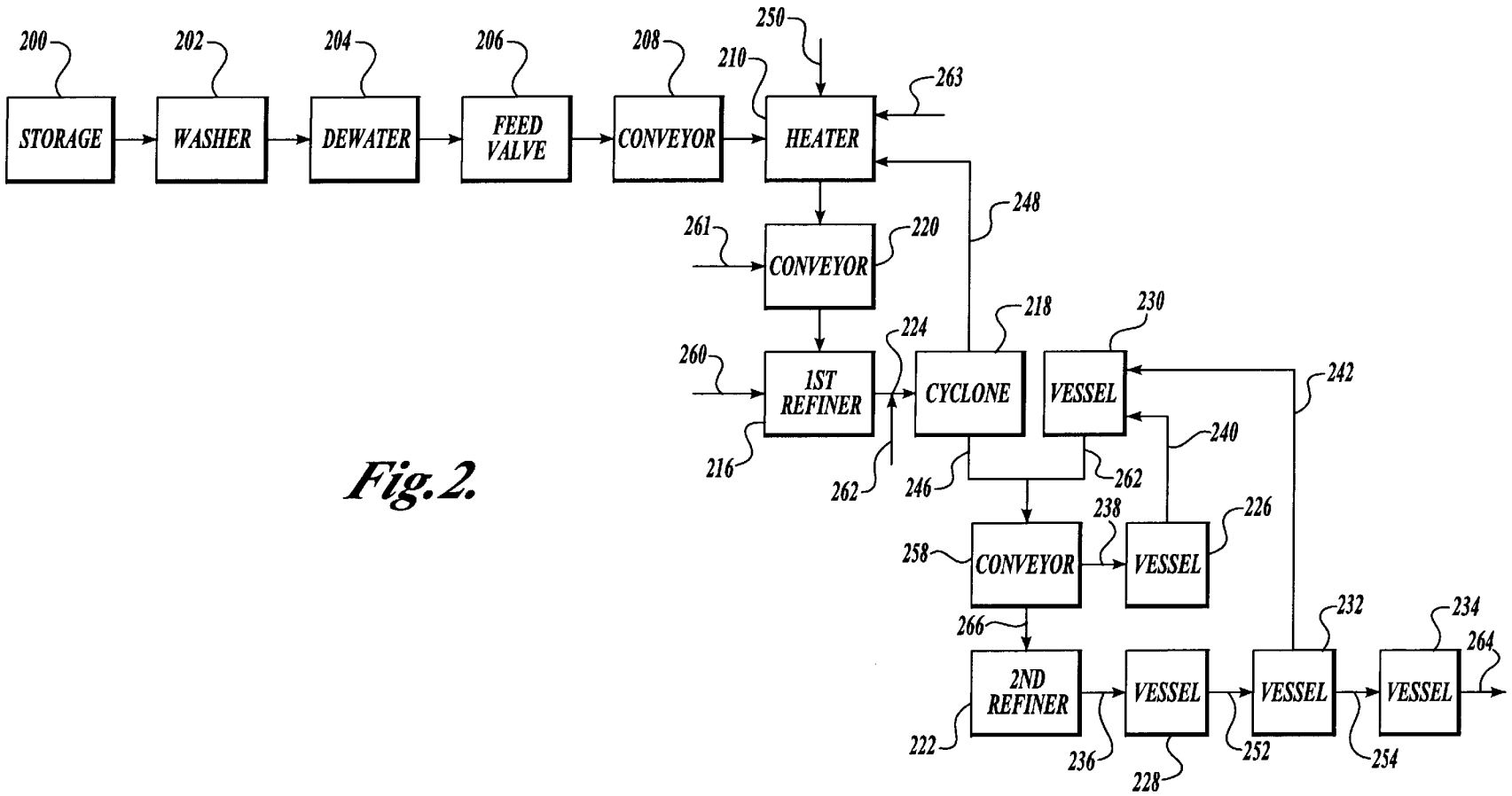
FIG. 2 shows a schematic illustration of a mechanical pulping section of a mill.

The method according to the invention treats the ground wood in the refining system of the mill, preferably, from prior to the first stage refiner through the second stage refiner as illustrated in FIG. 2, including the interstage section to advantageously use the elevated pressures and temperatures associated with the first stage refiner. The treatment includes mixing a bleaching composition (bleach liquor) including hydrogen peroxide ($H_2O_2$) and partially or completely substituting a differing alkali for 100% sodium hydroxide (NaOH), with the ground wood. As used herein, ground wood is intended to mean the cellulosic material, together with any other substances, including the bleaching composition, water or adjuvants. Ground wood, therefore, can also be the term applied to the slurry as it is carried forward in the process. Pulp is used interchangeably with ground wood, and also includes the resultant product made by the process according to the invention.

It is well known that the active species of hydrogen peroxide is the perhydroxyl ion, $HOO^-$. It is also well known that the equilibrium of the following reaction:

$$H_2O_2+OH^- \leftrightharpoons H_2O+HOO^- \quad \text{(Eq. 1)}$$

can be favored towards the right hand of the equation by increasing the pH of the solution to produce the desired $HOO^-$ species. A conventional source of alkalinity is sodium hydroxide. While sodium hydroxide is a viable alkali, reduced supplies and increased costs have meant a corresponding reduction in its production, making sodium hydroxide a less attractive source of alkalinity.

The method according to the invention replaces wholly or partially alkalinity derived from 100% sodium hydroxide with substitute alkali including magnesium hydroxide ($Mg(OH)_2$), and/or soda ash ($Na_2CO_3$), or any combination thereof at elevated temperatures. As used herein, alkali is meant to include any source of alkalinity from NaOH, $Mg(OH)_2$, and $NaCO_3$. Magnesium hydroxide and soda ash also provide buffer capacity to prevent wide swings in pH. When alkaline peroxide bleaching at high temperatures, better brightness is obtained when using a buffer (such as soda ash or magnesium hydroxide), instead of or in addition to sodium hydroxide. Buffering the system at lower pH (between about 9 to about 10.5) prevents peroxide decomposition and darkening, but still provides adequate alkalinity to produce the desired species. The buffer releases alkalinity as necessary, and provides just enough alkalinity for a slow and even production of the perhydroxyl ions. The present invention provides a supply of perhydroxyl ions as needed for bleaching and prolongs the effective bleaching time, making the peroxide more effective and giving higher brightness. According to the invention, the bleaching liquor includes a substitution of sodium hydroxide with magnesium hydroxide or soda ash in the range of anywhere greater than 0% to 100%, and suitably from about 40% to 100% on a weight percent basis. On an alkalinity basis, each pound of sodium hydroxide is the equivalent of about 0.73 pounds of magnesium hydroxide or about 1.31 pounds of soda ash.

According to the present invention, a suitable buffer and substitute alkali for sodium hydroxide is magnesium hydroxide which can be in any amount greater than 0% to 100% of what would be considered a suitable quantity of sodium hydroxide, preferably between about 40% to 100% of the suitable quantity of sodium hydroxide. A suitable quantity of sodium hydroxide has been found to be in the range of about 10 to about 100 pounds per ton of pulp on a dry basis. Then, according to the invention, the bleaching liquor at the suitable composition can contain about 2.92 to about 7.3 pounds of magnesium hydroxide at 40% replacement and about 29.2 to about 73 pounds of magnesium hydroxide at 100% replacement for the range of 10 to 100 pounds of sodium hydroxide, respectively, with any remainder of the alkalinity being supplied by sodium hydroxide. According to the present invention of providing methods for bleaching mechanical pulps, these amounts are suitable to use in such methods.

According to the present invention, a suitable buffer and substitute alkali for sodium hydroxide is soda ash that can be in any amount greater than 0% to 100% of what would be considered a suitable quantity of sodium hydroxide, suitably between about 40% to 100% of the suitable quantity of sodium hydroxide, and more suitably between about 50% to 100%. Then, according to the invention, the bleaching liquor at the suitable composition can contain from about 5.24 pounds to about 13.1 pounds at 40% replacement and from about 52.4 to about 131 pounds of soda ash at 100% replacement for the range of 10 to 100 pounds of sodium hydroxide, respectively, with any remainder of the alkalinity being supplied by sodium hydroxide. These amounts of alkali can be applied to the methods of brightening mechanical pulps, according to the present invention. Hydrogen peroxide is included in the bleaching liquor and can be added separately or concurrently with one or more of the liquor components.

According to the invention, a suitable amount of hydrogen peroxide in the bleaching liquor is about 10 to about 200 pounds per ton of pulp on a dry basis. The hydrogen peroxide is conventionally obtained from suppliers as a mixture of 60% water and 40% hydrogen peroxide on a weight basis, but other proportions of water and hydrogen peroxide can be used, provided they are equivalent to 10 to 200 pounds of a 60:40 mixture. An acceptable ratio of alkalinity to hydrogen peroxide is about 0.25 to about 3 on a weight basis of the 60:40 mixture. These amounts of hydrogen peroxide can be applied to the methods of brightening mechanical pulps according to the present invention.

The bleaching liquor can also contain suitable chelating agents, such as, but not limited to aminopolycarboxylic acids (APCA), ethylenediaminetetraacetic acid (EDTA), diethylene triamine pentaacetic acid (DTPA), nitrilotriacetic acid (NTA), phosphonic acids, ethylenediaminetetramethylene-phosphonic acid (EDTMP), diethylenetriaminepentamethylenephosphonic acid (DTPMP), nitrilotrimethylenephosphonic acid (NTMP), polycarboxylic acids, gluconates, citrates, polyacrylates, and polyaspartates or any combination thereof. A chelating agent may be added to the bleaching liquor in an amount up to 10% by weight. As with all other components of the bleaching liquor, chelating agents may be added separately or concurrently with one or more bleach liquor components at one or more chemical addition points in the refining system. Chelating agents are thought to bind metals to prevent the decomposition of hydrogen peroxide. In addition to chelating agents, the bleaching liquor can also include bleaching aids in amounts of up to 10% by weight. Bleaching aids further enhance the bleaching activity. Bleaching aids include adjuvants such as Chip Aid® and HP Booster supplied from Constant Labs of Montreal, Canada. Adjuvants such as chelating agents and bleaching aids can be applied to the methods of brightening mechanical pulps according to the invention.

The bleaching liquor can also contain a suitable amount of sodium silicate (silicate) up to about 10% by weight. Silicate in these amounts can be applied to the methods of brightening mechanical pulps according to the invention. Reference is made to the aforementioned articles for detailed descriptions of the chemical activity provided by chelating agents and silicates. Also, reference is made to *Pulp Bleaching: Principles and Practice*, by Carlton W. Dence and Douglas W. Reeve, which is herein incorporated by reference. Contrary to conventional wisdom, silicate need not be added as a component to the bleach liquor when thermomechanically pulping wood chips according to the present invention. It has been observed that when $Mg(OH)_2$ is substituted for NaOH in amounts up to 100%, it is not required to include silicate, to produce pulps having a brightness level similar to that which can be achieved when the alkali is NaOH and silicate is added to the bleach liquor, and the pulp and bleach liquor are held for about the same time and temperature conditions.

While the composition of the bleaching liquor has been described as a mixture, it should be readily apparent that the compounds of the bleach liquor can be added separately in differing parts of the refining system of the mill or concurrently as a mixture. For example, in one actual embodiment of a bleaching liquor that contains $Mg(OH)_2$, the $Mg(OH)_2$ is added at the first stage refiner, and any remaining alkali is added downstream in the interstage section. This embodiment is applicable to the methods for bleaching mechanical pulps according to the present invention.

It is known that several variables will influence and play a role in a pulp's brightness. Some of these variables are: consistency, residence time, temperature, and alkalinity.

The reaction shown as Eq. (1) above, is dependent on both pH and temperature. Either raising the temperature or the pH will drive the reaction of equation (1) to the right hand side producing more perhydroxyl species. According to the present invention, the values of the aforementioned parameters such as time, temperature and alkalinity have been determined to give greater brightness, improved yield, higher residual values of hydrogen peroxide and lower oxalate, COD and BOD concentrations, than is capable with 100% alkalinity derived solely from sodium hydroxide. The present invention takes advantage of the greater pressure and temperature produced by the refiners to arrive at the optimal value of the temperature and time parameters. Furthermore, the time which the pulp is in contact with the bleaching liquor can be adjusted by increasing or decreasing the rate of throughput of the pulp through the refiners and ancillary equipment such as the blowline, bleach tower and the surge vessels.

Depending on the raw material wood species, the initial brightness and potential brightness response of any mechanical or chemi-mechanical pulp will vary. The brightness response of the pulp to peroxide bleaching is closely related to the method of peroxide addition. For the most part, an increase in the peroxide dosage will lead to an increase in the pulp brightness. However, while a high brightness level is a desirable characteristic of pulps, the attainment of a high brightness level by dosing excessive amounts of alkali must be balanced by the danger of overdosing, which causes a darkening or yellowing of the pulp and reduces yield. Not enough alkalinity and inefficient bleaching is likely to occur. Too much alkalinity and the pulp undergoes yellowing, as well as inefficiently consuming the active perhydroxyl species by competing side reactions and wasting hydrogen peroxide. The brightness of pulps is measured by using TAPPI standards T452 and T525. According to the invention of providing methods for brightening mechanical pulps, a pulp brightness level can be achieved when a buffering substitute alkali of soda ash or magnesium hydroxide or a combination thereof is used, partially or wholly in place of sodium hydroxide, which is equal to or higher than the pulp brightness level attained by using solely sodium hydroxide. In one such method, the brightness of the pulp is increased by at least 1 brightness unit (ISO) in comparison to a method using only sodium hydroxide.

It is believed that hydrogen peroxide bleaching can brighten with minimal removal of the lignin from wood. Nevertheless, lignin and carbohydrates in mechanical pulps are subject to attack by nucleophiles ($HOO^-$ and $HO^-$), which is undesirable from a yield standpoint. Nucleophiles are thought to be present in the bleaching liquor. Nucleophiles can include the active oxygen species formed from hydrogen peroxide decomposition. For example, the perhydroxyl ions can oxidize polysaccharide chains to aldonic acids thereby degrading the cellulose molecules by what is called alkali promoted "peeling" reactions. Furthermore, hydroxide ions can effect the release of acetic acid in the pulp, leading to cellulose degradation. Also, acidic hemicelluloses dissolve in alkaline bleach solutions. Many of the reactions occurring when an alkali and hydrogen peroxide are brought in contact with pulp will reduce the total available quantity of the cellulosic fibers, contributing to an overall loss of cellulose. Yield relates to the amount of degradation of the carbohydrates of the cellulose fibers. Yield therefore is a measure of the overall efficiency of the pulping process. A high yield is desirable, which means that greater amounts of cellulose and lignin have undergone the refining and bleaching processes without appreciable degradation. Yield is a measure of the dry weight of the pulp produced by the process divided by the dry weight of the starting material or wood chips, the resulting fraction being expressed as a percentage. According to the invention of providing methods for brightening mechanical pulps, a higher yield at the end of the method can be attained when a buffering substitute alkali of soda ash or magnesium hydroxide or any combination thereof is used, which is higher than the yield attained by using solely sodium hydroxide as the alkali. In one method, the yield is increased by at least one-half of a percent in comparison to a method using only sodium hydroxide. In yet another method, the yield is greater than 95%. In the case of magnesium hydroxide, the magnesium is believed to chelate heavy metals and prevent radical formation and the associated cellulose degradation and yield loss.

It is also known that conventional processes using solely sodium hydroxide and hydrogen peroxide form compounds requiring oxidation to degrade into non-pollutant forms. The quantities used to measure these compounds are called COD (chemical oxygen demand) and BOD (biological oxygen demand). BOD and COD are theoretical numbers signifying the amount of oxygen required by aerobic microorganisms to transform the pollutants into harmless metabolites. If there are too many pollutants and not enough oxygen in an effluent treatment system, the natural biological degradation of these pollutants is hindered. Peroxide bleaching of mechanical pulps contributes to the levels of COD and BOD of the mill plant effluent. BOD and COD levels are known to be related to the amount of sodium hydroxide used in brightening mechanical pulps. Compounds adding to high COD and BOD levels are made primarily of organics and pulp residues, such as cellulose, hemicellulose, and lignin resulting from the pulp slurry solution. According to the invention, both the COD and the BOD levels of the pulping mill effluent streams can be reduced. COD is measured by the "HACH" test method, while BOD is measured using SM 5210. According to the invention of providing methods for brightening mechanical pulps, lower levels of COD and BOD can be attained at the end of the method when a buffering substitute alkali such as soda ash or magnesium hydroxide or any combination thereof is used partially or wholly in place of sodium hydroxide compared to the COD and BOD levels attained by using solely sodium hydroxide. In one method, the COD is reduced by at least 1 unit in kg/ODMT (oven-dry metric ton) in comparison to a method using only sodium hydroxide. In another method, the BOD is reduced by at least one-tenth of one unit in kg/ODMT in comparison to a method using only sodium hydroxide.

Consistency is a measure of the concentration of the pulp in the pulp slurry in relation to water. Consistency also plays a role in the final brightness achieved according to the present invention. The role of consistency has been, for the most part, of lesser concern than either temperature or time in producing the desired perhydroxyl ions necessary to achieve the bleaching effect in the present invention. However, in one method of the present invention for bleaching mechanical pulps, the consistency of the pulp is greater than 3%.

It is well known that metals play a role in the undesirable decomposition of hydrogen peroxide. A conventionally applied method to control decomposition of the hydrogen peroxide is the treatment of the wood chips or pulp with chelating agents. Chelating agents, such as the aforementioned agents, can be added to form organo-metallic complexes, essentially binding to metals and removing them from the chemical activity that would otherwise contribute to decomposition of hydrogen peroxide and thus, the perhydroxyl ion species. Accordingly, the present invention takes advantage of the chelating action of such agents. The bleaching liquor can include an amount of silicate up to about 10% by weight. A second approach to minimizing hydrogen peroxide decomposition is by the method of stabilizing the bleaching liquor. It is well known that sodium silicate can have a stabilizing influence on alkaline bleaching with hydrogen peroxide. Accordingly, the present invention also advantageously can include a step for controlling the decomposition of the bleaching liquor whereby the addition of sodium silicate (silicate) produces a stabilizing effect to minimize hydrogen peroxide decomposition. The bleaching liquor can include an amount of silicate up to about 10% by weight. It should be readily apparent that while the use of a chelating agent and silicate is known in the pulping art, their optimal quantities in any particular application are unknown since the many reactions and interactions between chemical species ultimately affect the final brightness results. According to the present invention of providing methods for bleaching mechanical pulps, the ranges of a chelating agent and silicate in the bleaching liquor for use in high temperature mechanical pulping applications and for a specific alkalinity dosage has been determined.

It is known that oxalate salts form detrimental deposits on mill bleaching equipment. It is of special concern if bleaching is occurring in the refiners, since any scale build up on the closely spaced rotating disks can cause premature failure and costly equipment maintenance, as well as incomplete pulp processing. According to the invention of providing methods for bleaching mechanical pulps, the amount of oxalic acid that is produced at the end of the method, when a buffering substitute alkali such as soda ash or magnesium hydroxide or any combination thereof is used partially or wholly in place of sodium hydroxide, is lower than the oxalic acid amount produced when using solely sodium hydroxide. In one method, the oxalate concentration of undiluted pressate is reduced by at least 10 mg/l, in comparison to a method using only sodium hydroxide. Accordingly, the present invention provides benefits by reducing the amount of scaling associated with bleaching. Scaling is controlled by reduced amounts of oxalate at a given brightness, and by the role magnesium plays in reducing oxalate production. Oxalate concentration is measured using TAPP1 method T699.

Residual hydrogen peroxide is an indication of the efficiency of the hydrogen peroxide effect in bleaching pulp. A reduction in the initial hydrogen peroxide dosing can also be attained if a final brightness level is desired. Hydrogen peroxide residual is defined as the amount of peroxide left unconsumed at the end of the bleaching process in comparison to the amount of hydrogen peroxide added to the process. Accordingly, the more residual peroxide remaining for a given quantity of pulp throughput, the more residual peroxide available for recycle back to the process or, alternatively, the throughput of the pulp can be increased to make use of residual peroxide or the hydrogen peroxide dosage can be initially reduced and still provide a brightness that is at least or less than the brightness that can be achieved by a method using only sodium hydroxide, but with a higher level of hydrogen peroxide. According to the present invention of providing methods for bleaching mechanical pulps, a higher level of residual hydrogen peroxide can be attained at the end of the method when a buffering substitute alkali such as soda ash or magnesium hydroxide or any combination thereof is used partially or wholly in place of sodium hydroxide, compared to the level of residual peroxide attained by using solely sodium hydroxide. In one method, the residual peroxide level is increased by at least 0.5%, in comparison to a method using only sodium hydroxide. In another method, the residual peroxide level is greater than 0.7%. Residual peroxide is measured using iodometric titration or EM science: reflectoquant peroxide test.

Implementation of the present invention of providing methods for bleaching mechanical pulps will now be described with reference to specific embodiments and the FIGURES.

Referring now to FIG. 2, a schematic representation of a thermomechanical two stage refining system of a TMP mill suitable for carrying out the present invention of providing methods for bleaching mechanical pulps is illustrated. Two stage refers to a process having at least one refiner operating above atmospheric pressure and at least one refiner operating at or about atmospheric pressure, so as to have an interstage section. Interstage refers to the section of the pulping system, including any associated equipment or the like, beginning with the exit of the first stage refiner and ending at the entrance to the second stage refiner. It should be readily appreciated that the configuration of a pulping system of a mill may have more or less unit operations as the one which is being presented herein. For illustration purposes, some ancillary equipment in the pulping system has been omitted. Still for illustration purposes, some ancillary equipment preceding or following the pulping system depicted in FIG. 2 has also been omitted.

Wood chips suitable for use as cellulosic material in the present invention can be derived from softwood tree species such as, but not limited to: fir (such as Douglas fir and Balsam fir), pine (such as Eastern white pine and Loblolly pine), spruce (such as White spruce), larch (such as Eastern larch), cedar, and hemlock (such as Eastern and Western hemlock). Examples of hardwood species from which pulp useful as a starting material in the present invention can be derived include, but are not limited to: acacia, alder (such as Red alder and European black alder) aspen (such as Quaking aspen), beech, birch, oak (such as White oak), gum trees (such as eucalyptus and Sweetgum), poplar (such as Balsam poplar, Eastern cottonwood, Black cottonwood and Yellow poplar), gmelina, maple (such as Sugar maple, Red maple, Silver maple and Bigleaf maple) and Eucalyptus.

Wood chips, that are produced in another area of the mill, or transported from outside the mill, or from whatever source, are stored in bins or silos 200. The chips are washed in a washer 202 prior to refining, followed by dewatering in a dewatering screen 204. Washing removes any grit or debris present in the chips which could damage the equipment and cause premature wear.

From the dewatering screen 204, the chips are moved through the process equipment by a rotary feed valve 206. The feed valve empties onto a conveyor 208, which can be a screw or a belt conveyor. However, any other suitable conveying apparatus can be used. From the conveyor 208, the chips are fed into a preheater 210. In this embodiment, the preheater 210 is a unit operation which uses recovered steam 248 from a downstream cyclone 218 and steam from a makeup line 250 to heat the chips prior to feeding into a first stage refiner 216. Chips are moved from the exit of the preheater 210 to the refiner 216 by the conveyor 220. Heating softens the chips which conserves energy in the refining stages. The first stage refiner 216 is a pressure refiner which can operate in the range of from slightly above atmospheric pressure to several tens of pounds per square inch pressure. Typical operating pressure is about 10 to 40 psi, but may be higher or lower. A refiner is commonly used in mechanical pulp mills. A refiner is a machine that mechanically macerates and/or cuts the wood into its constituent fibers, in essence, liberating the cellulosic fibers. There are two principal types of refiners: a disk refiner and a conical refiner. For a general discussion of refiners used in mechanical pulping, reference is made to the *Handbook of Pulping and Papermaking,* 2nd Ed., Christopher J. Biermann, which is herein incorporated by reference. Refining adds a substantial amount of heat energy from friction to the wood chips, which is emitted in the form of steam in downstream equipment and results in a temperature rise in the ground wood or pulp. The steam is collected downstream of the first stage refiner 216 in the cyclone 218. The pulp and steam travel through a blowline 224 which connects the exit of the first stage refiner 216 to the cyclone 218. The steam collected in the cyclone 218 is recycled to the preheater 210 for energy conservation purposes. The pulp stream 246 exiting from the cyclone 218 can be mixed with the recycled pulp rejects stream 262 and fed to a second stage refiner 222 via the conveyor 258. Vessels 226 and 230 provide surge and storage capacity for any pulp rejects 238, 240, 262 coming from the conveyor 258. While rejects 262 are shown being recycled to second stage refiner 222, rejects 262 may be pumped to other sections of pulp mill or discarded. Forward pulp in line 236 from second stage refiner 222, is further processed and dewatered in vessels 228, 232 and 234. Line 242 from vessel 232 carries recycled pulp rejects to second stage refiner 222 via reject vessel 230 and conveyor 258. The second stage refiner 222 is normally operated at about atmospheric pressure. The pulp from the second stage refiner 222 is fed into the vessel 228 where it is then pumped into one or a plurality of vessels 228, 232 and 234 and unit operations equipment for further processing which can include screening, cleaning and dewatering. The pulp 264 leaving the refining system, and produced according to the invention, may be further treated and/or processed in other sections of the pulp mill (not shown). The stream of rejects 238 taken from the feed 246 to the second stage refiner 222 is sent to a surge vessel 226 and then on to a dewatering vessel 230. From the dewatering vessel 230, the rejects are fed back to the second stage refiner 222.

Referring again to FIG. 2, a plurality of chemical addition points 260, 261, 262, and 263 are shown. A first chemical addition point 260, 261, and 263 can be before or at the primary refiner and a second chemical addition point 262 can be at a location which is interstage of the first 216 and second 222 refiners including blocks 218, 258, 226, 230, and all lines connected to such blocks. As used herein, when referring to "chemical addition at or in the primary refiner" means any block prior to or including the primary refiner 216 in FIG. 2 and prior to or including the blocks 324 and 326 in FIG. 3. According to the invention of providing methods for bleaching mechanical pulps, the bleaching liquor can be introduced in the first stage refiner 216 at 260 or at the interstage section between the first refiner 216 and the second refiner 222 at 262. Alternatively, one or a plurality of components of the bleaching liquor can be introduced at the first stage refiner 216 or preceding blocks and one or a plurality of components of the bleaching liquor can be introduced at the interstage section 224 or in any combination thereof. It should be pointed out that the interstage addition point can be at any vessel or line from the exit of the first stage refiner 216 to the entrance to the second stage refiner 222, including the units 218, 258, 226, 230 and the lines 224, 246, 262, 238, 240 and 266.

It should also be readily apparent that more or less units such as tanks, filters, vessels, first and second stage refiners, cyclones, pumps, conveyors, and valves can be used in a variety of combinations to provide for a two-stage mechanical pulping system.

Other thermomechanical pulping processes are described in U.S. Pat. No. 4,718,980 to Lowrie et al., which is herein incorporated by reference. All two stage mechanical pulping processes can be modified according to the present invention by the addition of a bleaching liquor at the first stage refiner and/or interstage and for the stated process conditions, to advantageously produce pulps having a higher brightness, higher yields, higher residual peroxide and less oxalate, COD and BOD production.

Figure 3:
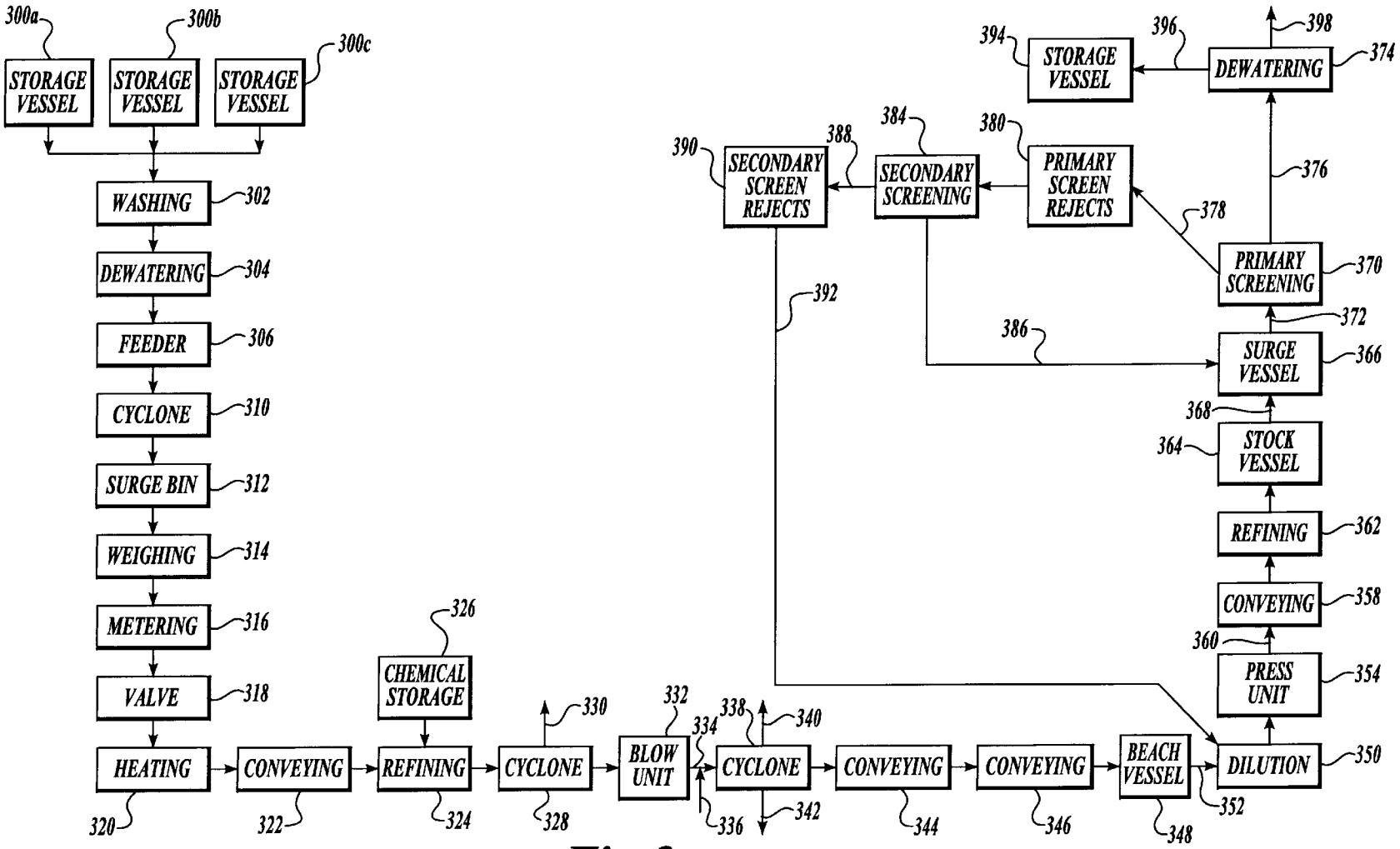
FIG. 3 shows a schematic illustration of a second embodiment of a mechanical pulping section of a mill.

Referring now to FIG. 3, an actual embodiment of a refining system of a mill with interstage and refiner chemical addition points according to the present invention is illustrated. Wood chips are stored in three adjacent silos 300*a*, 300*b* and 300*c*. The silos feed into a chip washing apparatus 302 where the chips are washed free of dirt and other undesirable constituents. A dewatering screen 304 separates the water from the chips. The chips are then moved by a rotary feeder 306 through a blow line (not shown) into a chip cyclone 310 and surge bin 312. The chip cyclone 310 and surge bin 312 can be made into a single piece of equipment or may be two distinct pieces separated by a line. From the surge bin 312, the chips are then weighed in the weight belt 314 and metered by metering screw 316 to feed into a pre-heater 320. The pre-heater 320 operates on steam to raise the temperature of the wood chips to soften them. The exit of the pre-heater 320 is connected to the cross screw conveyor 322. Prior to the entrance of the pre-heater 320, a valve 318 is present to control the wood chip supply. The screw conveyor 322 feeds the primary refiner 324. The pressure in the primary refiner can vary about 11 to 40 psi, but suitably operates about 30 to 33 psi, and at a consistency of about 10% to 50%, suitably about 23% to 45% and at a temperature of about 85° C. to about 160° C. Magnesium hydroxide, soda ash or alternatively sodium hydroxide can be stored in the vessel 326 and metered by metering pump (not shown) into the first stage refiner 324 or preceding blocks. Refining introduces substantial heat into the chips which is given off as steam 330 in the pressurized separating cyclone 328 exiting the first stage refiner 324. The waste steam 330 can be used in the digestor 320 or in other heat exchangers throughout the mill. The ground wood or pulp is moved from the first pressurized cyclone 328 to a second atmospheric cyclone 338 by blow unit 332 where further steam 340 is generated by the drop in pressure. The interstage section between the first refiner 324 and the second refiner 362 can also be used as an addition point 336 for one, some or all of the bleaching liquor components. Alkali, oxidants, silicates and chelating agents can be introduced into the blow line 334 at 336 between the first pressured cyclone 328 to the second atmospheric cyclone 338. However, other addition points in the interstage section are alternate embodiments. Alternate interstage addition points are blocks 326, 328, 332, 338, 344, 346, 348, 350, 354, 358, 390, 384, 380, and all lines into and leaving the blocks. Hydrogen peroxide 342 is introduced at the bottom of the atmospheric cyclone 338. However, other alternates may have the addition point at any location throughout the interstage section. From the atmospheric cyclone 340, the ground wood or pulp is moved by screw conveyors 344 and 346 into a peroxide tower 348 where the ground wood or pulp undergoes chemical activity to further brighten the ground wood or pulp. Average residence time can be adjusted at this stage from about 2 minutes to about 180 minutes or any time in between. The temperature can remain substantially at or about the exit temperature of cyclone 328. However, the temperature is expected to stay within the aforementioned ranges. Longer residence times can be achieved by increasing the size of the bleach tower 348. It should also be apparent that sample taps (not shown) can be placed at any location beginning with the first chemical addition point at or preceding the first stage refiner 324 to the second stage refiner 362 to sample the pulp after about 1 minute of residence time and throughout the process. From the peroxide tower 348, the pulp enters a dilution chest 350, where the consistency of the pulp is reduced and chemical activity is slowed. The pulp is then fed into a press 354 and then onto a second screw conveyor 358 and a second refiner 362. The second refiner operates at about atmospheric pressure and at a consistency of about 13% to 40% and within one of the aforementioned temperature ranges.

The pulp from the second refiner 362 empties into a refined stocked chest 364. From the refined stocked chest 364, the pulp 368 is pumped to surge chest 366. From surge chest 366, the pulp 372 is sent to primary screening unit 370. The pulp 372 is divided into two streams 376 and 378 at the primary screens 370. The accepts pulp stream 376 is sent to the dewatering screen 374. From the dewatering screen 374, water 398 is transferred to the white water chest (not shown). The finished pulp product 396 is sent to storage tanks 394. The rejects stream 378 from the primary screening unit 370 is sent to the primary screen reject chest 380. From the primary screen reject chest 380, the pulp is sent to a secondary screening unit 384. The secondary screening unit includes a rejects stream 388 and an accepts stream 386. The secondary screen rejects 388 are sent to the vessel 390 and further recycled to the dilution vessel 350 to mix with newly refined pulp 352 from the refiner 324. The accepts stream 386 enters surge chest 366 to be recycled again through primary screening unit 370. The rejects stream 392 thus undergoes further refining in secondary refiner 362.

EXAMPLE 1

Figure 17:
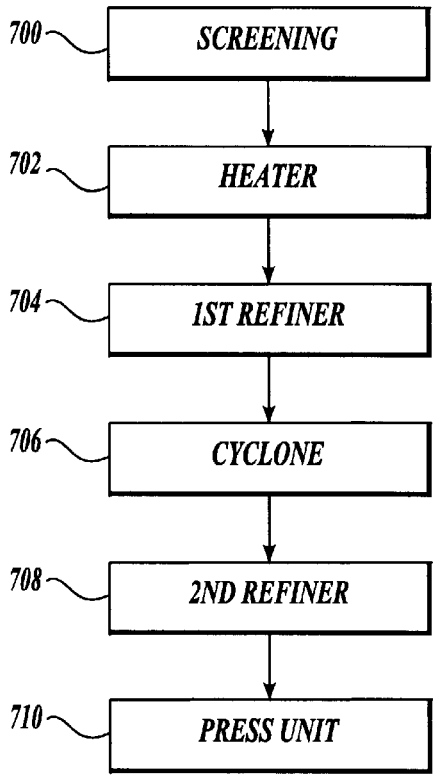
FIG. 17 shows a schematic illustration of a generic mechanical pulping system.

NORPAC chips (70% hemlock/30% pine) were refined at Andritz pilot research facility in Springfield, Ohio. A simplified schematic diagram showing several unit operations taking place in a generic TMP unit is illustrated in FIG. 17. It is to be appreciated that each TMP process may have more or less unit operations, before or following any of the blocks of the simplified process of FIG. 17, including but not limited to screens, washers, dryers, conveyors, pumps, and vessels. The pilot scale plant used in carrying out the Example 1 included at least the unit blocks of FIG. 17. The pilot plant includes, among other units, unit operations for screening the wood chips 700, presteaming the chips in block 702, a first refiner 704, a cyclone 706, a second refiner 708, and a press unit 710. A press unit 710 can be any suitable device to remove liquids from a pulp, including manually squeezing a pulp sample. No temperature measuring devices were installed in the pilot facility; however, it is estimated that the temperature at the first refiner was greater than 100° C., since the refiner was operated above atmospheric pressure. The temperature of the second refiner was estimated to be about 100° C. or greater, since the refiner operates near atmospheric pressure, also the pulp can retain much of the heat generated in the first refiner. It should be understood that the pilot scale plant may have more or less units than an otherwise, full scale commercial facility.

A 36-inch pressurized double disk refiner was used for the primary refining stage. Bleach liquor components were added in the first stage refiner and/or in the downstream interstage blowline. The bleaching liquor included about 3% peroxide of the 60:40 water to peroxide mixture, about 0.3% DTPA, and about 2% silicate. A total alkalinity to peroxide ratio of about 0.7 was used. On an alkalinity basis one pound NaOH has the same alkalinity as 0.73 pounds $Mg(OH)_2$ and 1.31 pound $Na_2CO_3$. The remainder of the bleaching liquor was made up of water and the alkali chemicals varied and applied according to the flow sheet schematic of FIG. 4 and Table 1 to produce a plurality of bleach liquor compositions for each run. After primary refining, pulp samples were taken from the primary refiner cyclone and placed in 55 gallon drums where they were held for up to 60 minutes of reaction time. These comprised the eleven runs depicted in Table 1. The Example used a drum as an interstage bleach vessel 348 which is representative of the interstage reaction capable of being carried out by the processes of FIGS. 2 and 3.

Figure 4:
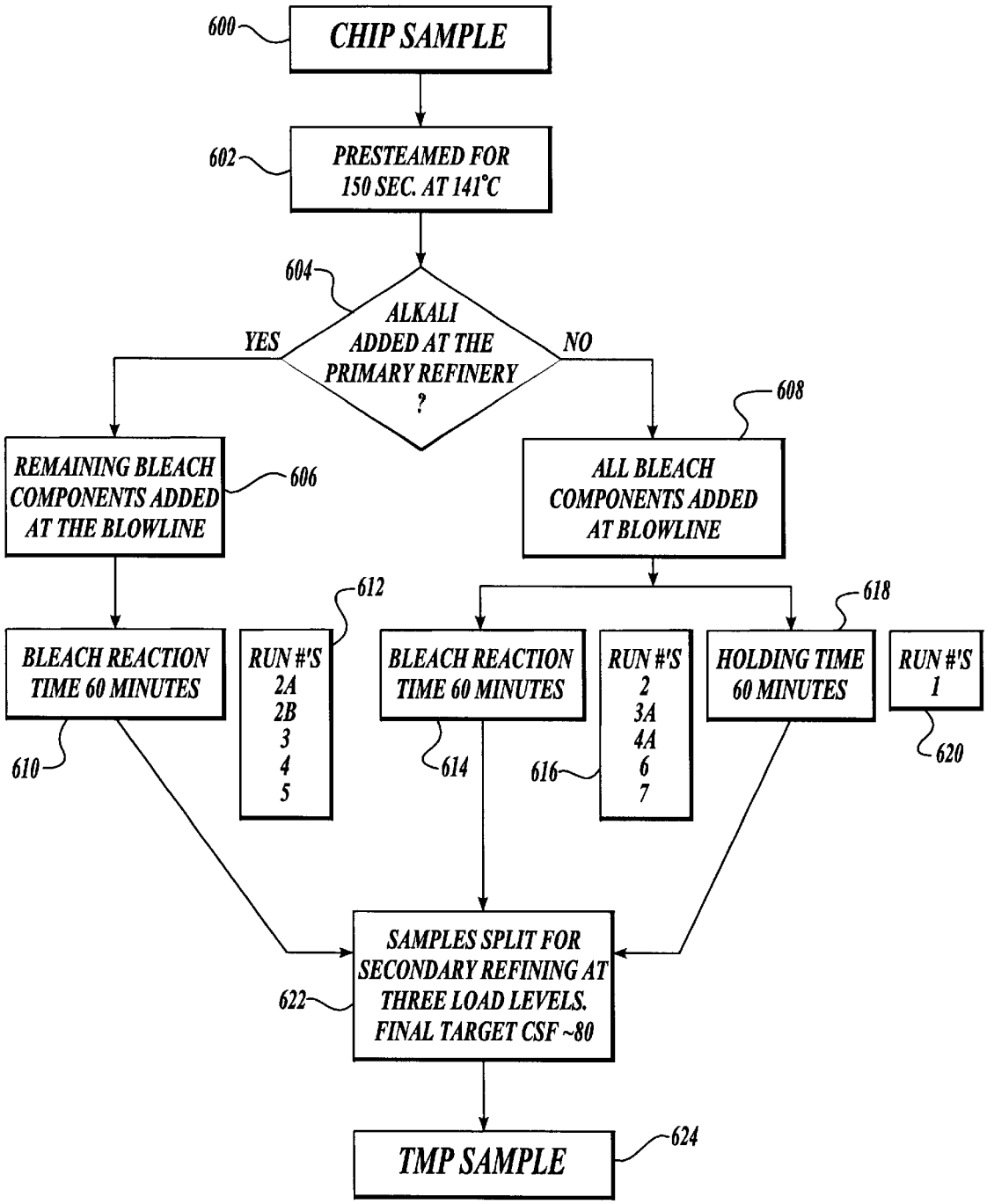
FIG. 4 shows a logic diagram for conducting lab sample studies of the pulping mill of FIG. 2 and FIG. 3.

FIG. 4 shows a decision diagram indicating how the data of Table 1 was collected. In block 600, a chip sample containing cellulose is provided. In block 602, the chip sample is pre-steamed for about 150 seconds at about 141° C. In block 604, a decision is made whether or not to add alkali at the primary refiner. If the answer in block 604 is yes, any remaining bleach components are added at the blowline or interstage section in block 606. If the answer in block 604 is no, all the bleach components are added at the blowline or interstage section in block 608. Approximately one gallon lab samples were taken from the 55 gallon drums and tested for brightness at intervals of 2, 15, 30, and 45 minutes. The lab samples were quenched and diluted to 1% to stop the reaction and make a brightness pad. This data is presented in Table 1. At 60 minutes of reaction time, a sample was pulled directly from the 55 gallon drum to measure brightness. The brightness, residual and yield is presented in the Table and FIGS. 6, 7, 11, and 12, from these samples. The drum samples, as opposed to the lab samples, were better able to maintain temperature due to the size of the samples.

Block 612 shows runs 2A, 2B, 3, 4, and 5 had alkali added at the primary refiner. In block 610, these runs are allowed to react for about 60 minutes, with lab samples being pulled and measured for brightness at 2, 15, 30, and 45 minute intervals, brightness was measured at 60 minutes using the drum sample. Block 616 shows runs 2, 3A, 4A, 6, and 7 did not have alkali added at the primary refiner. These runs had a reaction time of about 60 minutes. Lab samples were pulled and measured for brightness at 2, 15, 30, and 45 minute intervals, brightness was measured at 60 minutes using the drum samples. Block 620 shows that run 1 had components added at the blowline or interstage; however, run 1 did not include alkali as part of the bleach liquor. Therefore, in block 618, run 1 is, nevertheless, held for 60 minutes without any appreciable reaction.

In block 622, the drum samples are divided for secondary refining at three load levels. The drum samples were refined with any residual chemicals and pH leftover from the bleaching reaction, so that the pulps continued to react during secondary refining. The conditions at the secondary refiner were adjusted to provide further reaction times of about 65, 75, and 90 minutes of bleaching. In block 624, a thermal mechanical pulp sample after secondary refining is obtained for 65, 75, or 90 minutes. Total solids, oxalate content, COD, and BOD were measured using pressate samples from the lowest freeness pulp after secondary refining corresponding to the 90 minute sample.

Referring to Table 1, the summary results of the brightness measurements for eleven runs is presented at varying chemical concentrations and times. Runs appear in rows beginning on the left side of the table and are read across; there are eleven (11) runs. Runs 2a and 2b had sodium hydroxide added at the primary refiner. Run 2b had silicate as well added at the primary refiner. Runs 3, 4 and 5 had $Mg(OH)_2$, added to the primary refiner. Conditions are for 3% by weight hydrogen peroxide. Brightness was measured against time. The samples were taken from the blow line, reference numeral 334 in FIG. 3. The highest brightness level for a pulp after two minutes of bleaching is a level of 55 brightness units by run 3, with about 40% of the alkali being magnesium added at the primary refiner with the balance being sodium hydroxide added interstage. After fifteen minutes, the highest brightness level for a pulp is 57.7 brightness units from the same run. After thirty minutes, the highest brightness level for a pulp is 57.9 brightness units, once again from the same run. After forty-five minutes, the highest brightness level for a pulp is 58.2 units, achieved by run 7, with 100% of the alkali being soda ash added interstage.

Brightness after sixty minutes of reaction time is also shown. The highest brightness level for a pulp after 60 minutes of bleaching time is 62.5 units by run 3 with 40% magnesium hydroxide added at the primary refiner and 60% sodium hydroxide added interstage. The pH range for the pulp samples 3, 3a, 4, 4a, 5, 6, and 7, having some amount of sodium hydroxide substitution at sixty minutes of bleaching is from 8 to 8.3. The residual hydrogen peroxide achieved with a substitute alkali is between 1.13% and 1.52% after sixty minutes of reaction time for the same samples; the highest residual for a substituted alkali was 1.52% for 100% soda ash added interstage. However, the highest residual value was 2.24% for 100% sodium hydroxide and silicate, added at the primary refiner.

Brightness after the secondary refiner was also measured. The highest brightness level for a pulp after about 65 minutes of reaction time was 66.1 brightness units by run 3, with 40% magnesium hydroxide added at the primary refiner and 60% sodium hydroxide added interstage. The highest brightness level for a pulp after 75 minutes is 67.4, attained by run 4 with 50% magnesium hydroxide added at the primary refiner and 50% soda ash added interstage, and also attained by run 7 with 100% soda ash added interstage. The highest brightness level for a pulp after about 90 minutes of reaction time is 69.5 achieved by run 7 with 100% soda ash added interstage. The final pH varied between 7.6 and 8.2 for the pulp samples 3, 3a, 4, 4a, 5, 6, and 7, containing substitute alkali compounds. The hydrogen peroxide residual varied between 1.09% and 1.32% for the same runs containing some amount of substitute alkali. The highest peroxide residual level of 1.32% was achieved by run 7, with 100% soda ash added interstage. The highest residual recorded at 60 minutes was 2.24% for 100% sodium hydroxide and silicate, added at the primary refiner.

TABLE 1

ALTERNATIVE ALKALI BLEACHING TRIAL DATA

| BLEACHING CONDITIONS | | | Brightness verses Time after the Blowline {LAB SAMPLES} | | | | Brightness after 60 min reaction time {REFINER SAMPLER} | | |
|---|---|---|---|---|---|---|---|---|---|
| CASES AT 3% PEROXIDE | Chemicals Added in Primary Refining | Run #/ Reaction Time | 2 | 15 | 30 | 45 | 60 | pH | $H_2O_2$ Residual, % |
| Control with no chemicals | No | 1 | 41.6 | | | | 45.3 | | |
| Control with 100% NaOH | No | 2 | 44.9 | | | | 59.4 | 8.5 | 0.66 |
| Control with 100% NaOH | 100% NaOH | 2a | 42.7 | 49.8 | 50.7 | 50.8 | 56.4 | 8.1 | 1.81 |
| Control with 100% NaOH | 100% NaOH & Silicate | 2b | 45.3 | 52 | 52.4 | 54.1 | 57.6 | 8.3 | 2.24 |
| 60% NaOH, 40% Mg(OH)2 | 40% Mg(OH)2 | 3 | 55 | 57.7 | 57.9 | 58.1 | 62.5 | 8.2 | 1.38 |
| 60% NaOH, 40% Mg(OH)2 | No | 3a | 39.4 | 46 | 47 | 48.9 | 61 | 8 | 1.19 |
| 50% Mg(OH)2, 50% Na2CO3 | 50% Mg(OH)2 | 4 | 41.5 | 50.8 | 53.9 | 55.6 | 61.4 | 8.1 | 1.3 |
| 50% Mg(OH)2, 50% Na2CO3 | No | 4a | 45 | 49.3 | 52.5 | 53.2 | 58.5 | 8.1 | 1.47 |
| 100% Mg(OH)2 | 100% Mg(OH)2 | 5 | 39.5 | 48.3 | 48.9 | 50.9 | 62.4 | 8 | 1.13 |
| 50% NaOH, 50% Na2CO3 | No | 6 | 49.8 | 53.7 | 54.7 | 54.9 | 61.6 | 8.3 | 1.31 |
| 100% Na2CO3 | No | 7 | 50 | 54.8 | 57.1 | 58.2 | 61.9 | 8.2 | 1.52 |

Data is not available for blank cells

| BLEACHING CONDITIONS | | BRIGHTNESS AFTER SECONDARY REFINING {REFINER SAMPLER} | | | | |
|---|---|---|---|---|---|---|
| CASES AT 3% PEROXIDE | Chemicals Added in Primary Refining | 60-1 ~65 mins | 60-2 ~75 mins | 60-3 ~90 mins | Final pH | $H_2O_2$ Residual, % |
| Control with no chemicals | No | 47.7 | 47.6 | 49.2 | | |
| Control with 100% NaOH | No | 63 | 63.8 | 65.1 | 8.1 | 0.56 |
| Control with 100% NaOH | 100% NaOH | 59.3 | 59.6 | 60.6 | 7.8 | 1.70 |
| Control with 100% NaOH | 100% NaOH & Silicate | 61.3 | 61.7 | 63.8 | 7.9 | 1.82 |
| 60% NaOH, 40% Mg(OH)2 | 40% Mg(OH)2 | 66.1 | 67.2 | 67.8 | 8 | 1.24 |
| 60% NaOH, 40% Mg(OH)2 | No | 63.7 | 64.5 | 66.1 | 7.9 | 1.14 |
| 50% Mg(OH)2, 50% Na2CO3 | 50% Mg(OH)2 | 65.2 | 67.4 | 67.4 | 8.1 | 1.29 |
| 50% Mg(OH)2, 50% Na2CO3 | No | 63.7 | 64.7 | 65.5 | 7.7 | 1.17 |
| 100% Mg(OH)2 | 100% Mg(OH)2 | 65.4 | 66.9 | 68.1 | 7.7 | 1.10 |
| 50% NaOH, 50% Na2CO3 | No | 64.9 | 66.8 | 67.9 | 8.2 | 1.09 |
| 100% Na2CO3 | No | 65.2 | 67.4 | 69.5 | 7.6 | 1.32 |
| | | ~200–300CSF | ~100–200CSF | ~60–100CSF | | |

RESULTS

The sample data are representative of the results possible by a mill process. The mill process of FIG. 3 dilutes and slows the bleaching reaction in block 350 before the pulp is fed to the secondary refiners. In the Example conducted according to the method of bleaching mechanical pulps, the pulp was not diluted nor was the reaction quenched before the second refiner. The pulp was refined with the residual chemicals and the pH of the bleaching reaction conditions. The data suggests that significant efficiency is possible if the reaction was not quenched after the interstage bleach tower 348.

Figure 5:
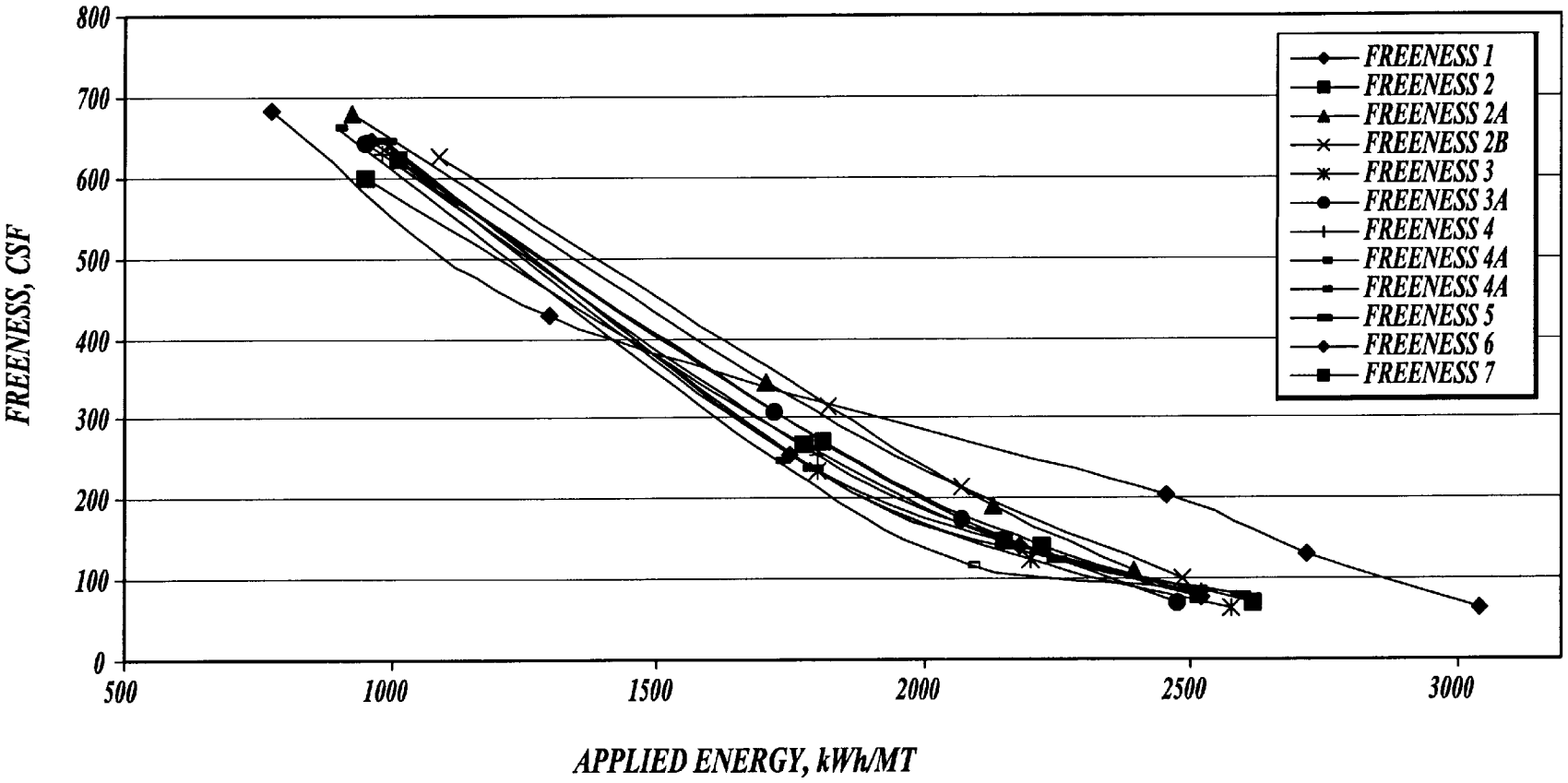
FIG. 5 shows a graphical illustration of the energy requirements of sample runs according to the present invention.

Refining energy was about the same among the runs, except that there was a considerable advantage of about 15% in energy requirements of interstage treatments over run 1, the unbleached control. Runs 2a and 2b, when sodium hydroxide was added to the primary refiner, showed slightly higher energy requirements over the other treatments. The energy requirements are depicted in FIG. 5.

Figure 6:
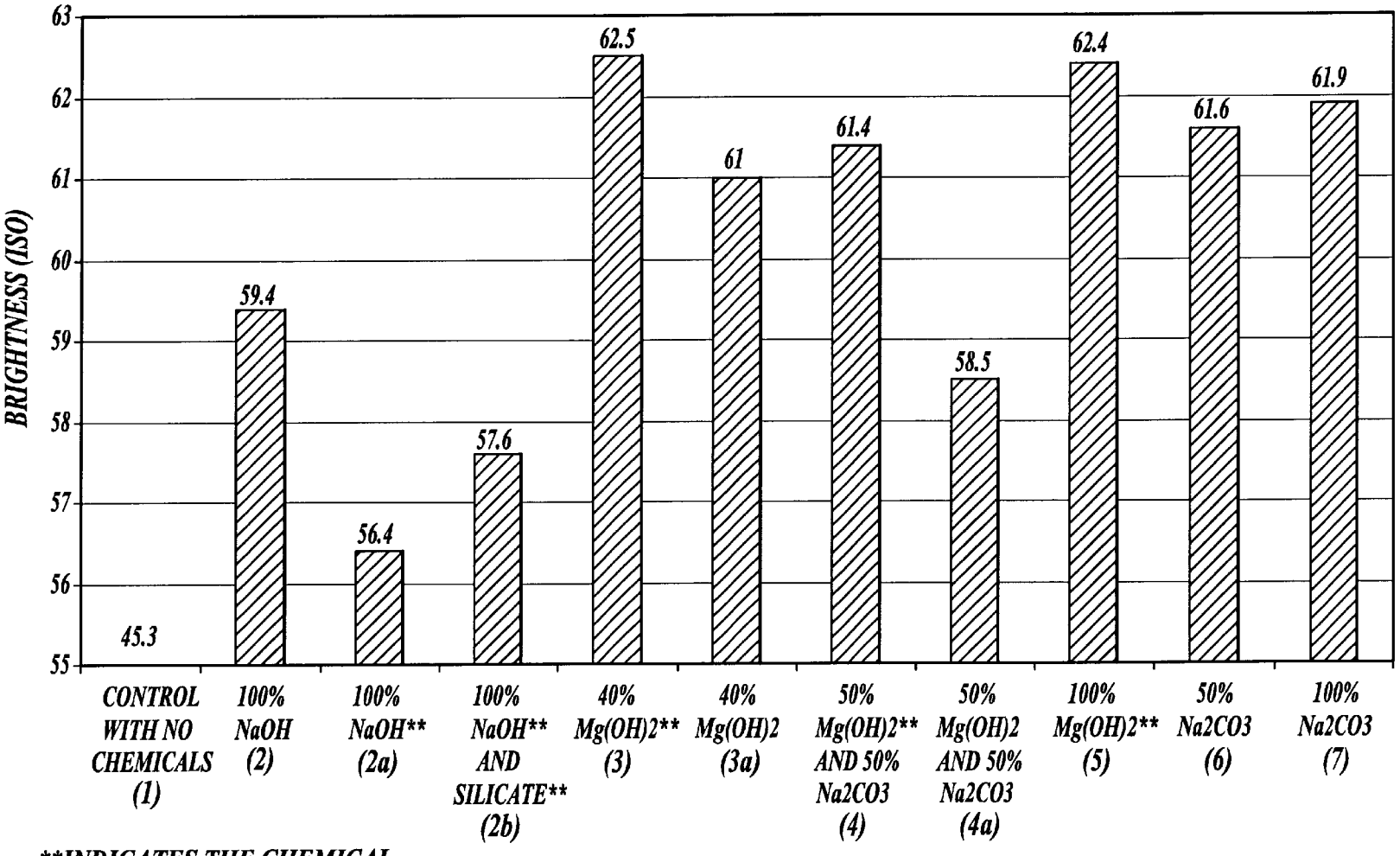
FIG. 6 shows a graphical illustration of the brightness results of the sample runs according to the present invention.

FIG. 6 shows the interstage brightness values after about 60 minutes of bleaching reaction for each of the 11 runs of Table 1, listed vertically in rows. The pulp of run 2 with 100% sodium hydroxide added interstage had a brightness of 59.4. By changing to a bleach liquor with a substitute alkali having 40% to 100% $Mg(OH)_2$ added at the primary refiner, a change in brightness from the previous run 2 resulted in a brightness increase of about 3.0 to about 3.1 points. Pulp samples 2a, 2b, 3, 4, and 5 were runs where an alkali chemical (either NaOH, $Mg(OH)_2$ or NaOH with silicate) was added to the primary refiner. Comparison of samples 3 with 3a, and 4 with 4a, shows the brightness increase is significantly reduced when magnesium hydroxide is added to the interstage blow line and not at the primary refiner. However, the opposite is true for NaOH. See runs 2 and 2a. However, an increase is noted when silicate was also added with NaOH at the primary refiner. See run 2b. The pulp of runs 6 and 7 containing soda ash also resulted in a brightness increase of as much as 2.5 points in comparison to run 2.

Figure 7:
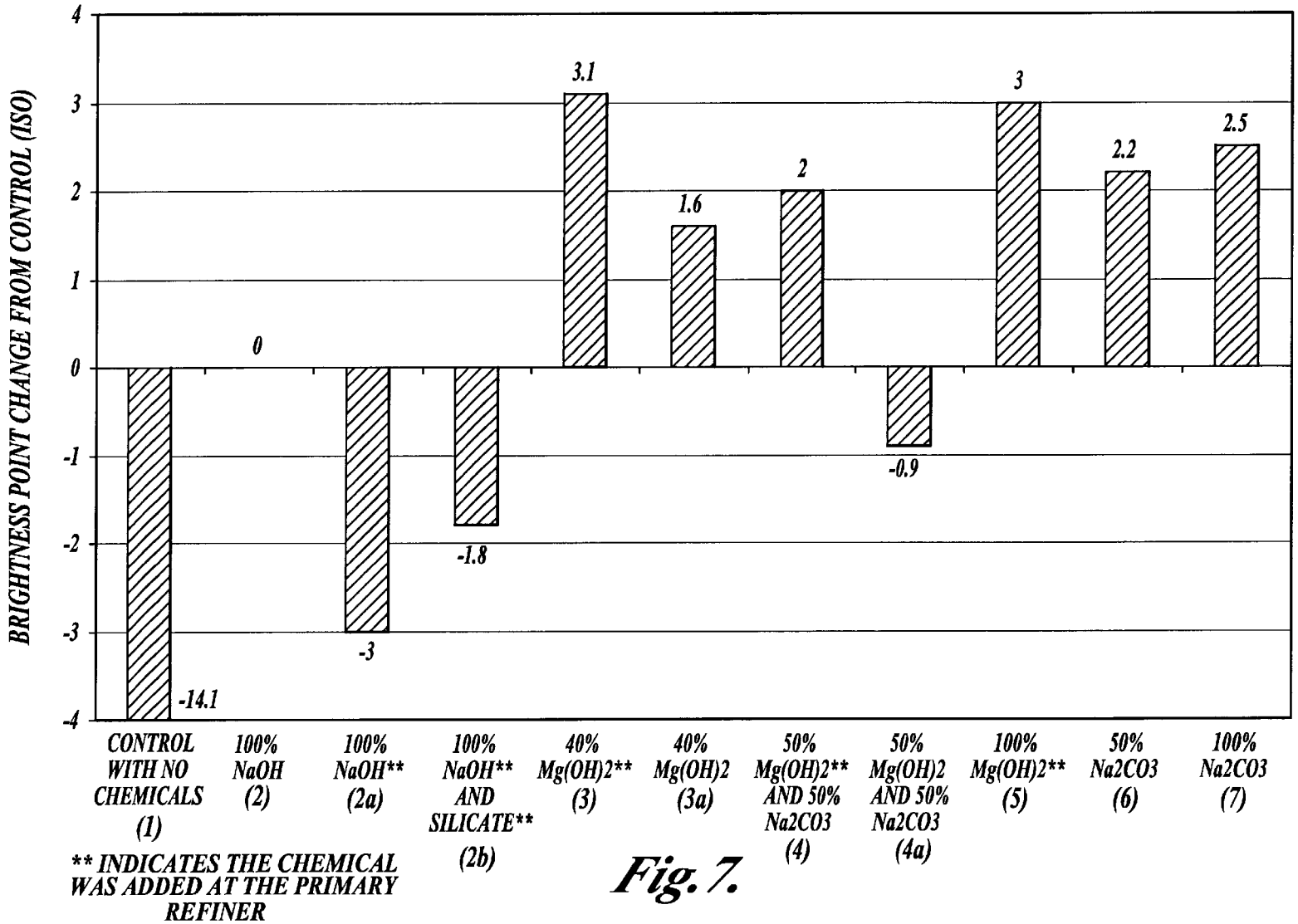
FIG. 7 shows a graphical illustration of brightness point changes of the sample runs in comparison to a control according to the present invention.

FIG. 7 shows the differences in brightness levels of pulp in comparison to the pulp sample of run 2 when 100% of the alkali is NaOH added interstage.

Figure 8:
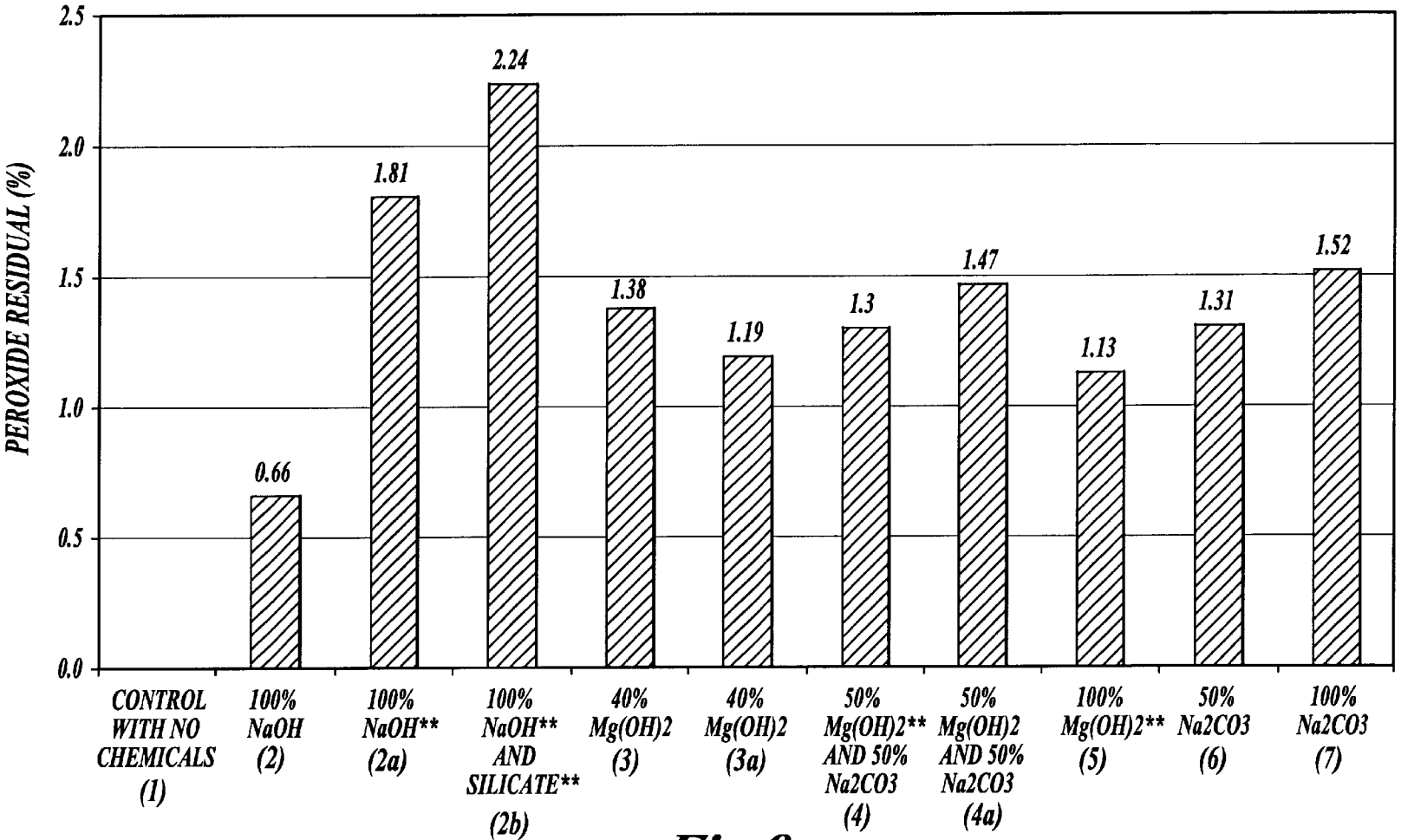
FIG. 8 shows a graphical illustration of peroxide residual results of the sample runs according to the present invention.

FIG. 8 shows the peroxide residual results. These peroxide residual values are from the 60 minute samples. The pulp of run 2 with 100% sodium hydroxide added interstage had a peroxide residual of 0.66%. All of the runs 2a–7, having alkali substitution resulted in an increase of 70–130% larger peroxide residual values than run 2 which means a range of about 1.13% to about 1.52%. The increased peroxide residual represents an opportunity for further bleaching if sufficient time and temperature were available. However, 100% NaOH added at the primary refiner, like in run 2a or 2b gave the highest residual values of 1.81% and 2.24%, respectively. The bleach liquor run 2b also included silicate added at the primary refiner.

Figure 9:
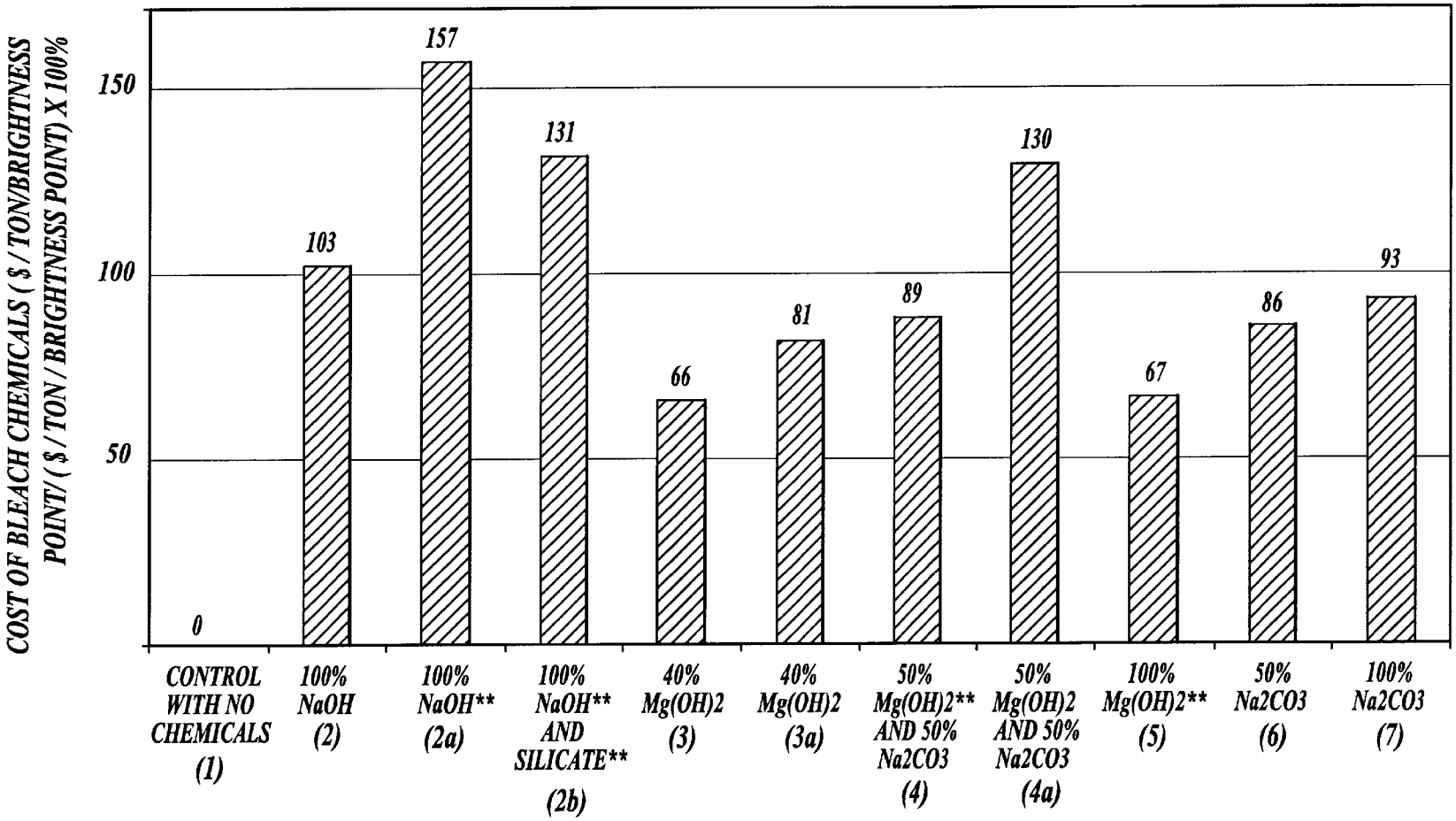
FIG. 9 shows a graphical illustration of the cost of bleach chemicals in dollars per ton per brightness point according to the present invention.

FIG. 9 shows the percent increase of runs 2–7, in costs of bleach chemicals for brightness point per ton in comparison to a control with no chemicals, run 1. Bleach chemical cost is lowest for the magnesium hydroxide containing bleach liquors of runs 3 and 5. Using an alternative substitute alkali reduces the cost of bleaching by allowing the use of less bleach chemical to reach a given brightness level.

Figure 10:
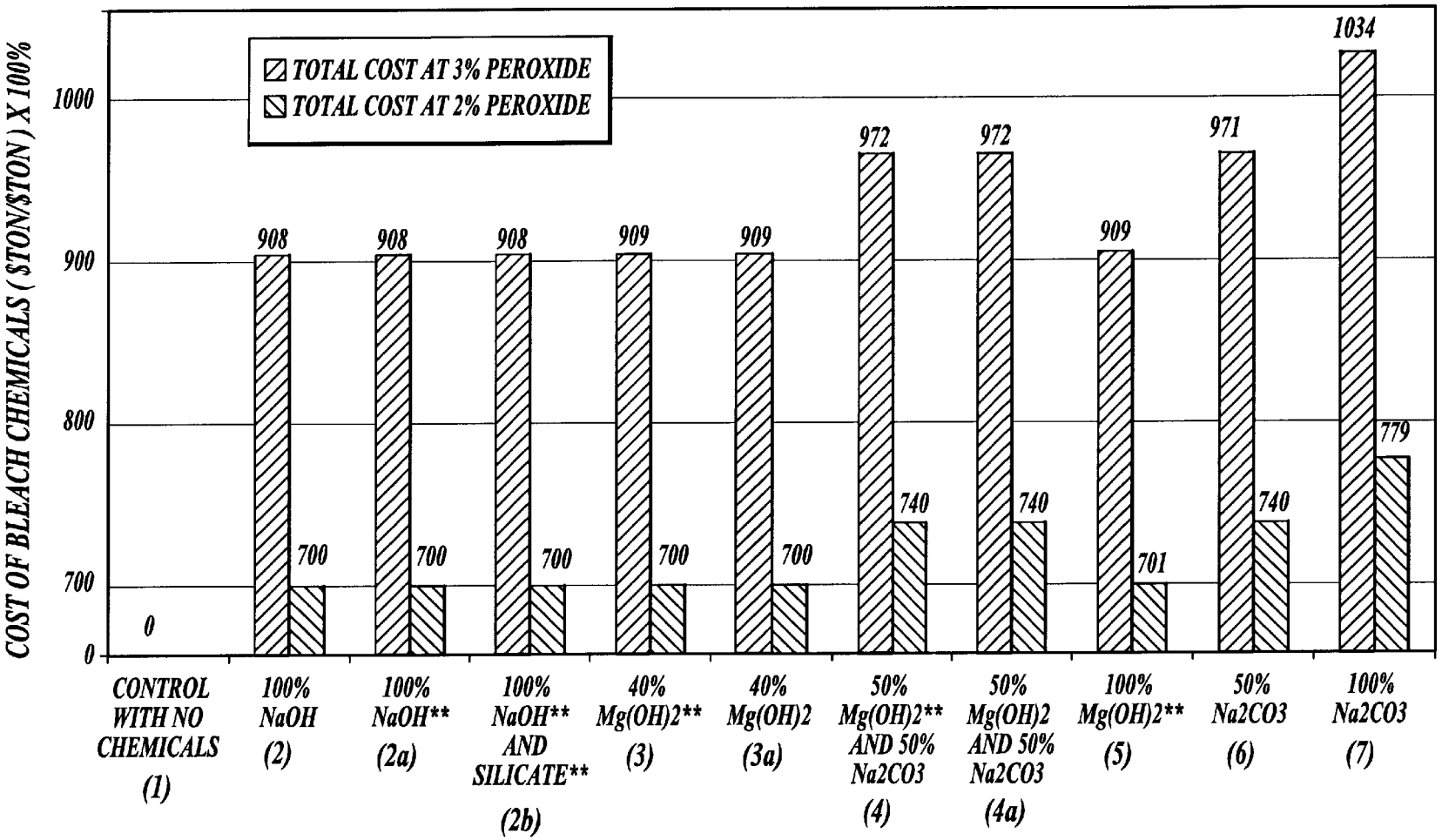
FIG. 10 shows a graphical illustration of the cost of bleach chemicals in dollars per ton.

FIG. 10 shows the percent increase of runs 2–7, in bleach chemical costs of 2% and 3% peroxide in comparison to a control with no chemicals, run 1. Momentarily, referring back to FIG. 6, runs 2, 3, and 6 at 3% peroxide showed an increase in brightness of about 3 points which can translate to a reduced peroxide application going from 3% to 2% hydrogen peroxide application with an attendant cost savings by using $Mg(OH)_2$. Since soda ash is generally more expensive than magnesium hydroxide, the cost savings are somewhat less, but still significant if soda ash is used.

Figure 11:
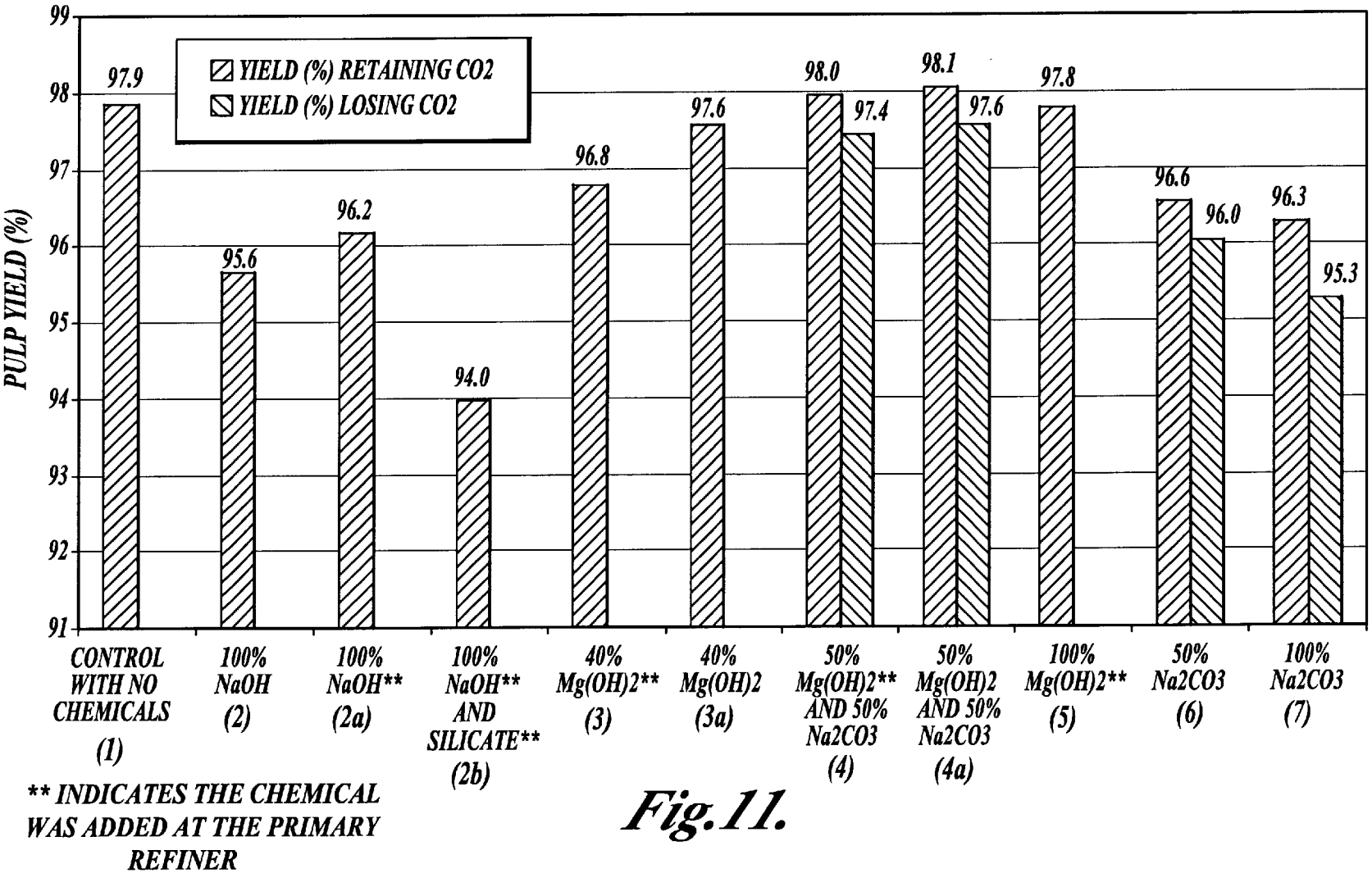
FIG. 11 shows a graphical illustration of the pulp yields of the sample runs according to the present invention.

Yield, total solids, oxalate content, COD and BOD, and were measured on pulp samples leaving a press unit and being the lowest freeness pulp after secondary refining for each of the runs. The pressate samples are undiluted. The total bleach time was about 1.5 hours for these pulp samples. Pulp yield values are shown in FIG. 11. The pulp yield value was calculated from pressed bleach liquor solids after the weight of chemicals is subtracted. Yield values of pulps when using bleach liquors containing soda ash are given with and without retention of $CO_2$, as it is possible that some or all of the $CO_2$ present in the soda ash is released during bleaching. $CO_2$ may evolve from the breakdown of $Na_2CO_3$ caused by the high temperatures. The calculations of yield, therefore, assume both a breakdown of $Na_2CO_3$ into $CO_2$ (i.e., loss) and with no breakdown (i.e., retain). The pulp yield when using the bleach liquor of run 2 with 100% NaOH added interstage was 95.6%. The highest pulp yields were attained with bleach liquor having 50% $Mg(OH)_2$ and 50% $NA_2CO_3$, at 98.0 and 98.1, respectively, assuming retention of $CO_2$. Only a slight improvement was noted when $Mg(OH)_2$ was added at the primary refiner. The highest yield for a bleach liquor with 100% $Mg(OH)_2$ is 97.8, added at the primary refiner.

Figure 12:
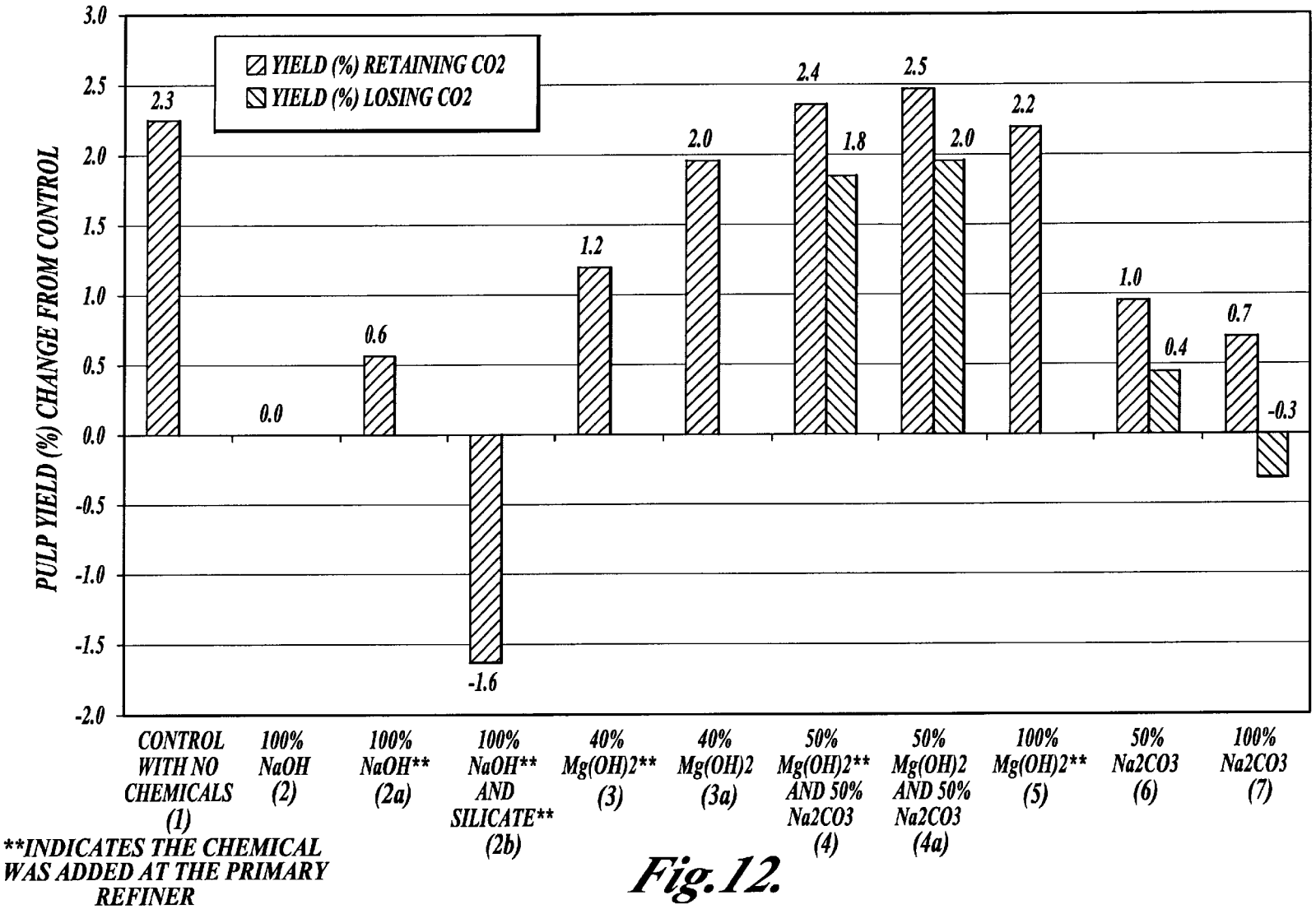
FIG. 12 shows a graphical illustration of the pulp yield changes of the sample runs in comparison to a control according to the present invention.

The change in pulp yield from the control of run 2 is shown in FIG. 12. For all runs with some degree of substitute alkali, an increase in yield was realized. Run 7, taking into consideration $CO_2$ losses, was the only run which showed a decrease in yield compared to run 2. There was an increase in pulp yield of up to 2.2% for substitution with magnesium hydroxide of up to 100% added at the primary refiner. The bleach liquors containing soda ash, runs 6 and 7, showed from 0–1% increase in yield. The yield increases are consistent with the decreases seen in COD and BOD. Combination runs 4 and 4a, of 50% magnesium hydroxide and 50% soda ash realized the greatest increases in yield, when not taking into consideration any $CO_2$ losses. The highest yield increase of 2.5 was seen with run 4a, a 50% $Mg(OH)_2$, 50% $Na_2CO_3$ mixture, where chemicals were added interstage, for an overall pulp yield of 98.1.

Figure 13:
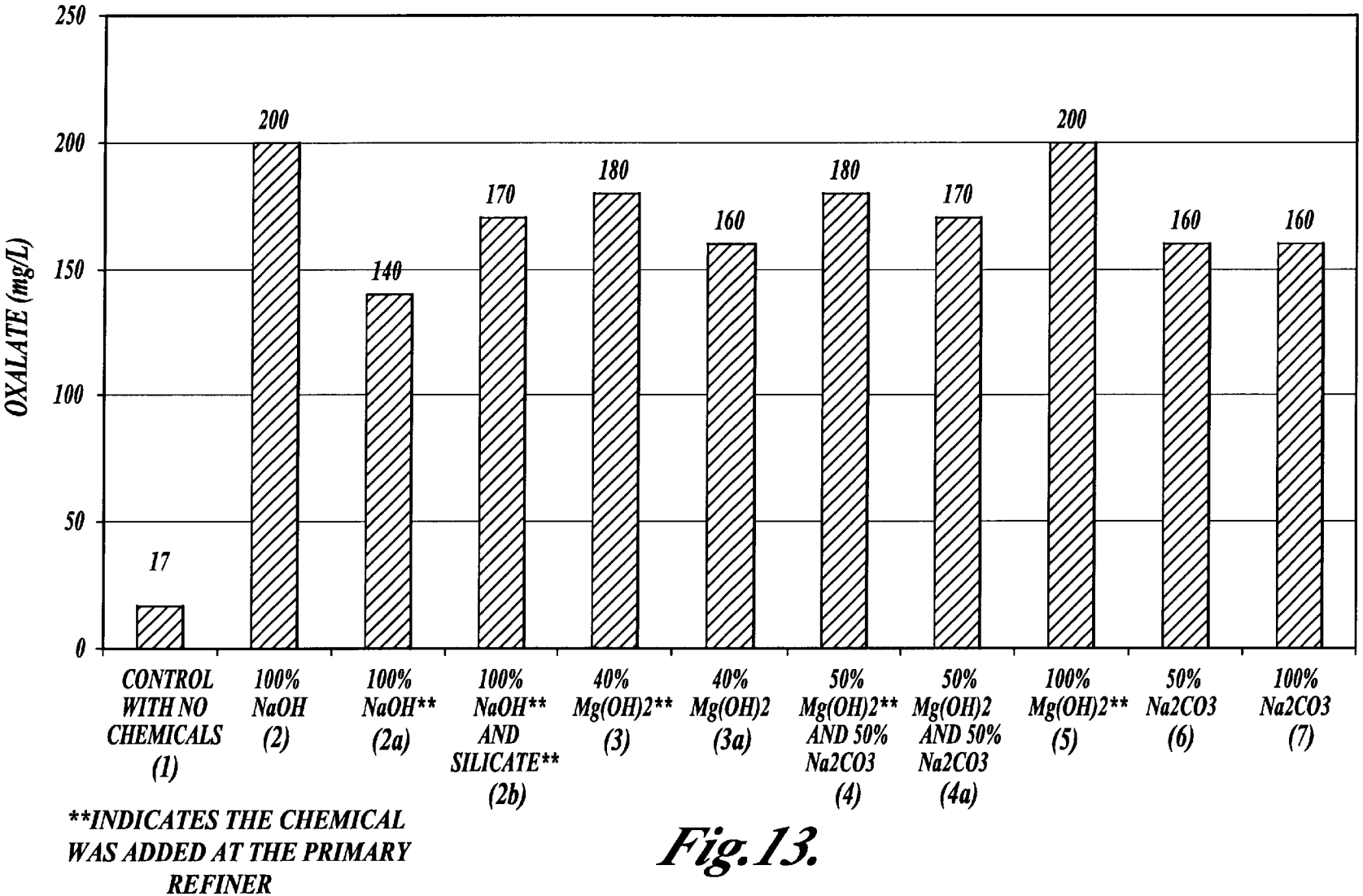
FIG. 13 shows a graphical illustration of the oxalate concentration of the sample runs according to the present invention.

FIG. 13 shows the oxalate content of the undiluted pressate samples for each run. The undiluted pressate from the unbleached sample, run 1, had an oxalate content of 17 milligrams per liter, while the sample from run 2 with 100% NaOH added interstage had an oxalate content of 200 milligrams per liter. Generally, oxalate is 5–20% lower for the substituted alkali pulps, with the exception of run 5 with 100% $Mg(OH)_2$, added at the primary refiner, which was about even with the control of run 2. The lowest oxalate was recorded for run 2a, the sample treated with 100% NaOH, added to the primary refiner, at 140 mg/L. The lowest oxalate levels for runs with a substitute alkali are runs 3a, 6, and 7, all with an oxalate level of 160 mg/L. These were pulps treated with 40% $Mg(OH)_2$, 50% $Na_2CO_3$, and 100% $Na_2CO_3$, where none of the chemical is added at the primary refiner but at the interstage section. The reduction of peroxide use through increased pulp brightness will provide additional decreases in oxalate.

Figure 14:
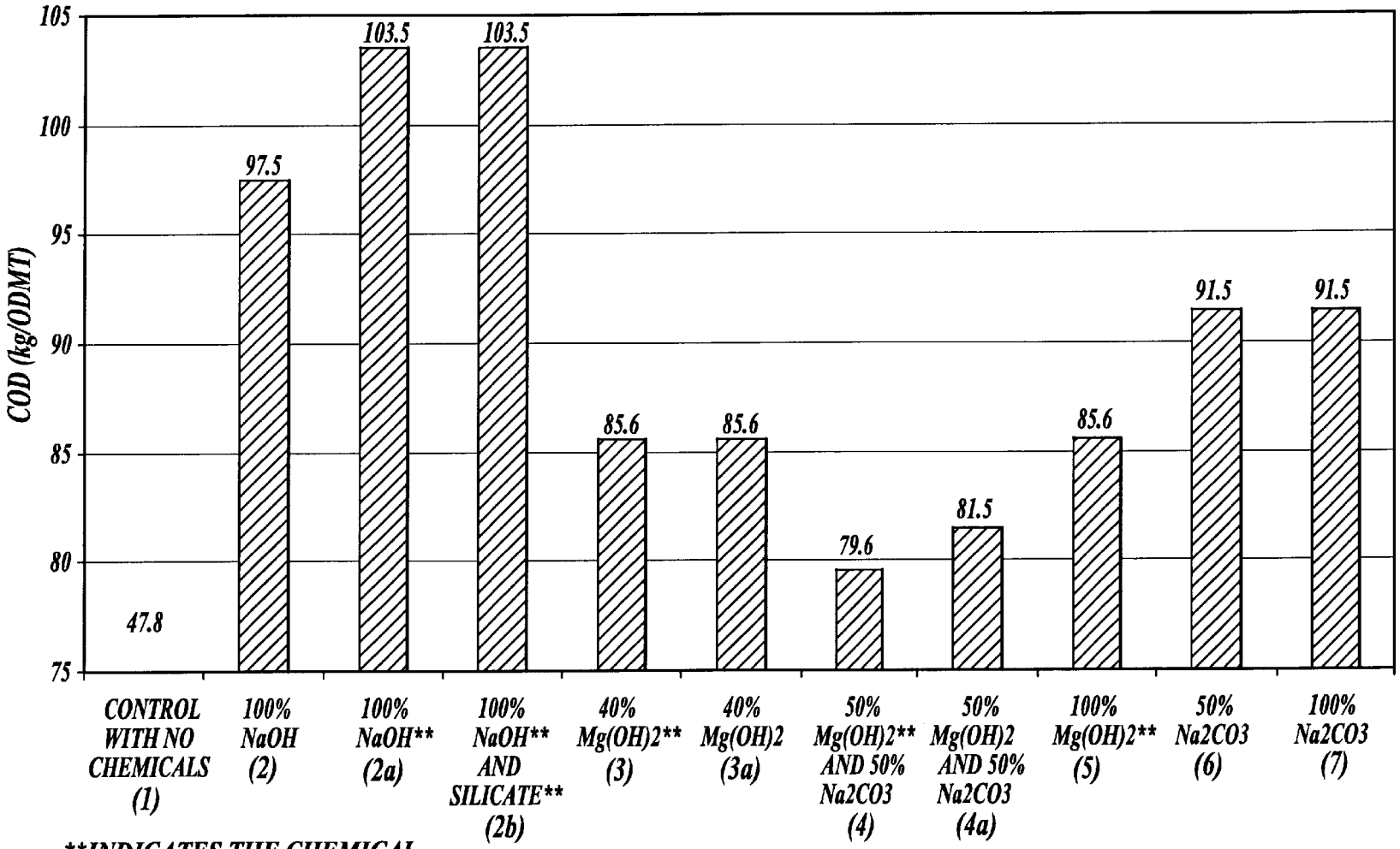
FIG. 14 shows a graphical illustration of the COD concentration of the sample runs according to the present invention.

FIG. 14 shows the COD values of the samples for each run. The pulp of run 2 showed a COD level of 97.5 kg/ODMT, for 100% NaOH added interstage. There was a decrease in the COD of up to 18% for the runs having substituted alkali bleach liquors in comparison to sample 2, with 100% NaOH. The runs having magnesium-only bleach liquors, samples from runs 3, 3a, and 5, showed a decrease of up to 15% in comparison with sample 2, while the runs having soda ash-only bleach liquors, samples from runs 6 and 7, showed a decrease of up to 6% in comparison with sample 2, and the runs having combination magnesium hydroxide and soda ash bleach liquors, samples 4 and 4a, showed a decrease in COD of about 17–18% in comparison to sample 2. The lowest COD measurement was for run sample 4 with an overall COD level of 79.6 kg/ODMT for a bleach liquor having 50% $Mg(OH)_2$ and 50% $Na_2CO_3$, where $Mg(OH)_2$ is added at the primary refiner and $Na_2CO_3$ is added interstage.

Figure 15:
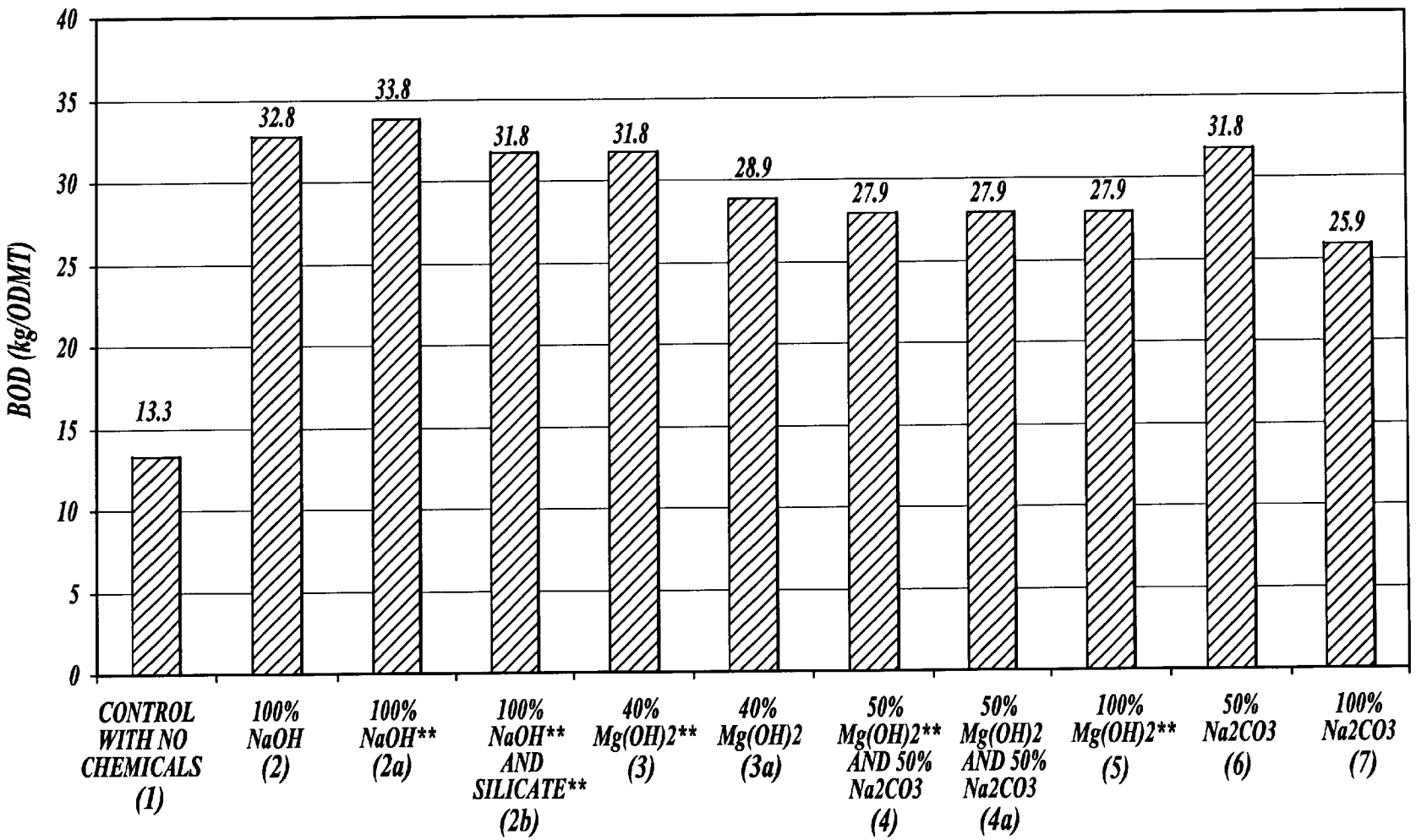
FIG. 15 shows a graphical illustration of the BOD concentration of the sample runs according to the present invention.

FIG. 15 shows the change in BOD of the samples for each run. The pulp of run 2 showed a BOD level of 32.8 kg/ODMT, for 100% NaOH added interstage. There was a decrease in BOD by as much as up to 21% for the samples using substituted alkali bleach liquors in comparison to sample 2 with 100% NaOH added interstage. The samples using magnesium hydroxide-only bleach liquors, run samples 3, 3a, and 5, showed a percent decrease in BOD of about 3% to about 14.9%, in comparison to run sample 2 with 100% NaOH added interstage. The samples using soda ash-only bleach liquors, run samples 6 and 7, showed a percent decrease in BOD of about 3% to about 21%, in comparison to run sample 2 with 100% NaOH added interstage. The combination bleach liquor run samples 4 and 4a, showed a percent decrease in BOD of about 14.9%, in comparison to run sample 2 with 100% NaOH. The lowest BOD reading for a pulp was recorded for sample 7, using 100% $Na_2CO_3$, added interstage, at 25.9 kg/ODMT. A reduction in peroxide use will result in further decreases in BOD.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A method of brightening mechanical pulp, comprising the steps of:

providing cellulosic materials derived from softwood or hardwood trees, said materials having an initial brightness level, introducing the cellulosic materials to a refining system for conversion to a pulp, providing a bleaching liquor to the refining system, wherein the liquor comprises hydrogen peroxide and alkali, wherein the alkali comprises at least one of $Mg(OH)_2$ and $Na_2CO_3$, or a combination thereof;

holding the pulp and the bleaching liquor at a temperature in the range of about 85° C. to about 160° C. for a time of about 2 to about 180 minutes; and increasing the brightness of the pulp at least to a brightness level which can be obtained if 100% of the alkali is NaOH and the pulp and bleaching liquor are held at about the same time and temperature conditions.

2. The method of claim 1, further comprising the step of:

increasing the pH of die pulp to within the range of about 9 to about 10.5.

3. The method of claim 1, wherein the temperature is greater than 100° C. to about 160° C.

4. The meted of claim 3, wherein the time is from about 10 minutes to less than about 180 minutes.

5. The method of claim 3, wherein the time is from greater than 60 minutes to less than 120 minutes.

6. The method of claim 3, wherein the time is from greater than 2 minutes to less than 60 minutes.

7. The method of claim 1, wherein the bleaching liquor comprises an amount of alkali which is the equivalent of about 10 to about 100 pounds of NaOH per ton of pulp on a dry basis.

8. The method of claim 7, wherein about 40% to about 100% of the alkali is $Mg(OH)_2$.

9. The method of claim 7, wherein about 50% to about 100% of the alkali is $Na_2CO_3$.

10. The method of claim 1, wherein the bleaching liquor comprises hydrogen peroxide in an amount of about 10 to about 200 pounds per ton of pulp on a dry basis.

11. The method of claim 1, wherein the consistency of the pulp is greater than about 3%.

12. The method of claim 1, wherein the ratio of alkali to hydrogen peroxide is about 0.25 to about 3 on a weight basis.

13. The method of claim 1, wherein the bleaching liquor further comprises a chelating agent in an amount up to about 10% by weight.

14. The method of claim 13, wherein the chelating agent is selected from the group consisting of aminopolycarboxylic acids (APCA), ethylene-diaminetetraacetic acid (EDTA), diethylene triamine pentancetic acid (DTPA), nitrilotriacetic acid (NTA), phosphonic acids, ethylenediaminetetramethylene-phosphonic acid (EDTMP), diethylenetriaminepentamethylenephosphonic acid (DTPMP), nitrilotrimethylenephosphonic acid (NTMP) polycarboxylic acids, gluconates, citrates, polyacrylates, and polyaspartates or any combination thereof.

15. The method of claim 1, wherein the bleaching liquor further comprises silicate in an amount up to about 10% by weight.

16. The method of claim 1, wherein the brightness of the pulp is increased by at least about 1 brightness unit (ISO).

17. The method of claim 1, wherein the refining system defines a first and second refiner and an interstage section between the first and second refiner.

18. The method of claim 17, wherein an amount of alkali is provided at the first refiner.

19. The method of claim 18, wherein the alkali is $Mg(OH)_2$.

20. The method of claim 17, wherein an amount of alkali is provided at the interstage section.

21. The method of claim 20, wherein the alkali is $Na_2CO_3$.

22. The method of claim 1, defining an ending residual peroxide level, wherein the residual peroxide level is increased in comparison to the residual peroxide level obtained if 100% of the alkali is NaOH and the pulp and bleaching liquor are held at about the same time and temperature conditions.

23. The method of claim 22, wherein the residual peroxide level of the pulp is increased by at least about 0.5%.

24. The method of claim 1, wherein the residual peroxide level is greater than about 0.7%.

25. The method of claim 1, defining an ending pulp yield, wherein the pulp yield is increased in comparison to the pulp yield obtained if 100% of the alkali is NaOH and the pulp and bleaching liquor are held at about the same time and temperature conditions.

26. The method of claim 25, wherein the pulp yield is increased by at least about one-half of a percent.

27. The method of claim 1, wherein the pulp yield is greater than about 95.9%.

28. The method of claim 1, defining an ending oxalate concentration wherein the oxalate concentration is decreased in comparison to the oxalate concentration obtained if 100% of the alkali is NaOH and the pulp and bleaching liquor are held at about the same time and temperature conditions.

29. The method of claim 1, wherein the oxalate concentration of undiluted pressate is reduced by at least about 10 mg/l.

30. The method of claim 1, defining an ending COD level wherein the COD is decreased in comparison with the COD if 100% of the alkali is NaOH and the pulp and bleaching liquor are held at about the same time and temperature conditions.

31. The method of claim 30, wherein the COD is reduced by at least about 1 unit in kg/ODMT.

32. The method of claim 1, defining an ending BOD level, wherein the BOD is decreased in comparison with the BOD if 100% of the alkali is NaOH and the pulp and bleaching liquor are held at about the same time and temperature conditions.

33. The method of claim 32, wherein the BOD is reduced by at least about one-tenth of one unit in kg/ODMT.

34. The method of claim 1, wherein the refining system defines a first and second refiner, wherein the bleaching reaction is not quenched before the second refiner.

35. The method of claim 1, wherein the bleaching liquor further comprises a bleaching aid in an amount up to about 10% by weight.

36. The method of claim 1, wherein the bleaching liquor comprises a charge of hydrogen peroxide that is about the equivalent of 3% by weight of a solution of 60:40 water to hydrogen peroxide.

37. The method of claim 1, wherein the bleaching liquor comprises a charge of hydrogen peroxide that is about the equivalent of 2% by weight of a solution of 60:40 water to hydrogen peroxide.

38. A method of brightening mechanical pulps, comprising the steps of:

providing cellulosic materials derived from softwood or hardwood trees, said materials having an initial brightness level, introducing the cellulosic materials to a refining system for conversion to a pulp, providing a bleaching liquor to the refining system, wherein the liquor comprises a first amount of hydrogen peroxide and an alkali, wherein the alkali comprises at least one of $Mg(OH)_2$ and $Na_2CO_3$, or a combination thereof;

providing the pulp with the bleaching liquor at a temperature in the range of about 85° C. to about 160° C. for a time of about 2 to about 180 minutes; and increasing the brightness of the pulp about equal to or less than a brightness level which can be obtained if the bleaching liquor comprises a second amount of hydrogen peroxide, which is greater than the first amount, wherein 100% of the alkali is NaOH, and the pulp and bleaching liquor are held under about the same temperature and time conditions.

39. The pulp made by the method of claim 1, having a brightness of at least about 55 ISO.

40. The pulp of claim 39, having a brightness of about 55 to about 69.5 ISO.

41. A method of brightening mechanical pulp, comprising the steps of:

providing cellulosic materials derived from softwood or hardwood trees, said materials having an initial brightness level, introducing the cellulosic materials to a refining system for conversion to a pulp, providing a bleaching liquor to the refining system, wherein the liquor comprises hydrogen peroxide, silicate and alkali, wherein the alkali comprises at least one of $Mg(OH)_2$ and $Na_2CO_3$, or a combination thereof;

holding the pulp and the bleaching liquor at a temperature in the range of about 85° C. to about 160° C. for a time of about 2 to about 180 minutes; and increasing the brightness of the pulp at least to a brightness level which can be obtained if 100% of the alkali is NaOH and the pulp and bleaching liquor are held at about the same time and temperature conditions.

* * * * *